US010328479B2

(12) United States Patent
Thielges

(10) Patent No.: US 10,328,479 B2
(45) Date of Patent: Jun. 25, 2019

(54) PUNCH ASSEMBLY WITH REPLACEABLE PUNCH TIP SECURED BY COUPLING PIN

(71) Applicant: MATE PRECISION TOOLING, INC., Anoka, MN (US)

(72) Inventor: Bruce Thielges, Fridley, MN (US)

(73) Assignee: Mate Precision Tooling, Inc., Anoka, MN (US)

( * ) Notice: Subject to any disclaimer, the term of this patent is extended or adjusted under 35 U.S.C. 154(b) by 398 days.

(21) Appl. No.: 15/019,572

(22) Filed: Feb. 9, 2016

(65) Prior Publication Data

US 2016/0229078 A1 Aug. 11, 2016

Related U.S. Application Data

(60) Provisional application No. 62/113,778, filed on Feb. 9, 2015.

(51) Int. Cl.

| | |
|---|---|
| ***B26D 7/26*** | (2006.01) |
| ***B26F 1/14*** | (2006.01) |
| ***B21D 28/34*** | (2006.01) |
| ***B21D 37/14*** | (2006.01) |

(52) U.S. Cl.

CPC ..... *B21D 28/34* (2013.01); *B21D 37/14* (2013.01); *B26D 7/2614* (2013.01); *B26F 1/14* (2013.01)

(58) Field of Classification Search

CPC ..... B26D 7/2614; B21D 28/34; B21D 37/14; B21D 28/346; B21D 45/006; B26F 1/14; Y10T 83/9423; Y10T 83/04; Y10T 83/929; Y10T 83/9428; Y10T 83/9476; Y10T 83/9486; Y10T 83/9457; Y10T 29/49826; Y10T 29/4995

USPC ..... 83/13, 684, 698.11, 698.21, 679, 694, 83/651, 686, 699.51, 699.61, 699.31, 697, 83/698.91

See application file for complete search history.

(56) References Cited

U.S. PATENT DOCUMENTS

| | | | |
|---|---|---|---|
| 199,715 | A | 1/1878 | Jenkins |
| 1,179,476 | A | 4/1916 | Thomas et al. |
| 1,377,292 | A | 5/1921 | Staron |
| 1,383,414 | A | 7/1921 | Mansell |
| 1,386,259 | A | 8/1921 | Jourdan et al. |
| 1,569,136 | A | 1/1926 | Pardee, Jr. |
| 1,726,012 | A | 8/1929 | Bilz |
| 1,784,911 | A | 12/1930 | Schlitters, Jr. et al. |

(Continued)

FOREIGN PATENT DOCUMENTS

| | | |
|---|---|---|
| BE | 1014961 A3 | 7/2004 |
| CA | 2098235 A1 | 12/1994 |

(Continued)

OTHER PUBLICATIONS

Applicant Interview Summary and Response to Final Office Action for U.S. Appl. No. 15/204,248, dated Apr. 17, 2017 (17 pages).

(Continued)

*Primary Examiner* — Ghassem Alie
(74) *Attorney, Agent, or Firm* — Dorsey & Whitney LLP

(57) ABSTRACT

A punch assembly includes a punch body having an axis and a replaceable punch tip configured for a punching operation, e.g., in a punch press apparatus. A laterally manipulated coupling pin is provided to selectively engage the punch tip with the punch body along the axis, and to selective disengage the punch tip from the punch body.

26 Claims, 18 Drawing Sheets

(56) References Cited

U.S. PATENT DOCUMENTS

| | | | | |
|---|---|---|---|---|
| 1,806,694 | A | 5/1931 | Markson | |
| 1,910,275 | A | 5/1933 | Alden | |
| 1,979,059 | A | 10/1934 | Wallman et al. | |
| 2,107,581 | A | 2/1938 | Parsons et al. | |
| 2,245,676 | A | 6/1941 | Johnson | |
| 2,380,343 | A | 7/1945 | Stellin et al. | |
| 2,420,146 | A | 5/1947 | Otto et al. | |
| 2,448,817 | A | 9/1948 | McArthur | |
| 2,522,440 | A | 9/1950 | Freter | |
| 2,614,781 | A | 10/1952 | Engel | |
| 2,801,859 | A * | 8/1957 | Kopczynski | B21D 28/34 279/86 |
| 2,805,866 | A | 9/1957 | Amend | |
| 2,893,291 | A | 7/1959 | Hollis | |
| 2,927,432 | A | 3/1960 | Parry | |
| 2,955,831 | A | 10/1960 | Zandberg et al. | |
| 2,974,967 | A | 3/1961 | Felmet | |
| 3,137,193 | A | 6/1964 | Whistler et al. | |
| 3,190,160 | A * | 6/1965 | Armacost | B21D 45/003 83/128 |
| 3,289,519 | A | 12/1966 | Piccone | |
| 3,447,455 | A | 6/1969 | Shneider | |
| 3,495,493 | A | 2/1970 | Herb et al. | |
| 3,530,750 | A | 9/1970 | Daniels | |
| 3,548,700 | A | 12/1970 | Herzog et al. | |
| 3,600,999 | A | 8/1971 | Dennis | |
| 3,640,170 | A * | 2/1972 | Bennett | B21D 28/34 83/698.91 |
| 3,641,860 | A | 2/1972 | Whistler et al. | |
| 3,735,993 | A | 5/1973 | Seibert | |
| 3,759,130 | A | 9/1973 | Patterson | |
| 3,763,730 | A | 10/1973 | Ahlegian | |
| 3,831,483 | A * | 8/1974 | Beauplat | B21D 28/12 83/698.91 |
| 3,904,816 | A | 9/1975 | Taudt et al. | |
| 4,092,888 | A | 6/1978 | Wilson | |
| 4,146,239 | A | 3/1979 | Martin | |
| 4,174,648 | A | 11/1979 | Wallis | |
| 4,273,015 | A | 6/1981 | Johnson | |
| 4,375,774 | A | 3/1983 | Wilson et al. | |
| 4,446,767 | A | 5/1984 | Wilson | |
| 4,487,566 | A | 12/1984 | Barna | |
| 4,503,741 | A | 3/1985 | Hunter | |
| 4,526,077 | A | 7/1985 | Deguvera | |
| 4,718,161 | A | 1/1988 | Pfister et al. | |
| 4,762,043 | A | 8/1988 | Sneed | |
| 4,850,755 | A | 7/1989 | Spencer | |
| 4,862,782 | A | 9/1989 | Ernst | |
| 4,951,375 | A | 8/1990 | Erlenmaier | |
| 4,989,484 | A | 2/1991 | Johnson et al. | |
| 5,020,407 | A | 6/1991 | Brinlee | |
| 5,044,244 | A | 9/1991 | Olson | |
| 5,131,303 | A | 7/1992 | Wilison et al. | |
| 5,146,832 | A | 9/1992 | Wilson et al. | |
| 5,271,303 | A | 12/1993 | Chatham | |
| 5,301,580 | A | 4/1994 | Rosene et al. | |
| 5,317,894 | A | 6/1994 | Southard | |
| 5,329,835 | A | 7/1994 | Timp et al. | |
| 5,647,256 | A | 7/1997 | Schneider | |
| 5,746,104 | A | 5/1998 | Russell et al. | |
| 5,752,424 | A | 5/1998 | Rosene et al. | |
| 5,832,798 | A | 11/1998 | Schneider et al. | |
| 5,839,341 | A | 11/1998 | Johnson et al. | |
| 5,884,546 | A | 3/1999 | Johnson | |
| 5,887,502 | A | 3/1999 | Yamaguchi et al. | |
| 6,047,621 | A | 4/2000 | Dries et al. | |
| 6,082,516 | A | 7/2000 | Willer | |
| 6,142,052 | A | 11/2000 | Endo | |
| 6,196,103 | B1 | 3/2001 | Sch et al. | |
| 6,276,247 | B1 | 8/2001 | Helda | |
| 6,334,381 | B1 | 1/2002 | Chatham | |
| 6,463,839 | B2 | 10/2002 | Ohtsuka et al. | |
| 6,782,787 | B2 | 8/2004 | Morehead et al. | |
| 6,895,797 | B2 | 5/2005 | Lowry et al. | |
| 6,895,849 | B2 | 5/2005 | Rosene et al. | |
| 7,051,635 | B2 | 5/2006 | Morehead | |
| 7,069,765 | B2 | 7/2006 | Grove et al. | |
| D526,667 | S | 8/2006 | Sakamoto et al. | |
| 7,156,009 | B2 | 1/2007 | Iwamoto et al. | |
| 7,159,426 | B1 | 1/2007 | Ghiran | |
| 7,168,356 | B2 | 1/2007 | Rosene et al. | |
| 7,658,134 | B2 | 2/2010 | Morgan et al. | |
| D629,025 | S | 12/2010 | Greenleaf et al. | |
| 7,900,543 | B2 | 3/2011 | Ikeda | |
| 7,975,587 | B2 | 7/2011 | Schneider | |
| 8,327,745 | B2 | 12/2012 | Lee et al. | |
| 8,408,111 | B2 | 4/2013 | Johnston | |
| D690,332 | S | 9/2013 | Morehead et al. | |
| D690,333 | S | 9/2013 | Morehead et al. | |
| D694,788 | S | 12/2013 | Carper et al. | |
| 8,707,841 | B2 * | 4/2014 | Morehead | B21D 28/34 83/686 |
| 8,714,065 | B2 | 5/2014 | Takahashi et al. | |
| D719,590 | S | 12/2014 | Johnston et al. | |
| D742,441 | S | 11/2015 | Johnston et al. | |
| D744,554 | S | 12/2015 | Shimota et al. | |
| D755,863 | S | 5/2016 | Shimota et al. | |
| D763,933 | S | 8/2016 | Johnston et al. | |
| 9,409,223 | B2 | 8/2016 | Morehead et al. | |
| D765,746 | S | 9/2016 | Johnston et al. | |
| 9,687,994 | B2 | 6/2017 | Lee et al. | |
| 9,776,337 | B2 | 10/2017 | Lee et al. | |
| 2003/0075034 | A1 | 4/2003 | Brenneke | |
| 2004/0200333 | A1 | 10/2004 | Seeley et al. | |
| 2004/0206223 | A1 | 10/2004 | Rosene et al. | |
| 2006/0060046 | A1 | 3/2006 | Sugizaki et al. | |
| 2006/0081107 | A1 | 4/2006 | Iwamoto et al. | |
| 2007/0034069 | A1 | 2/2007 | Endo et al. | |
| 2007/0068352 | A1 | 3/2007 | Morgan | |
| 2007/0144232 | A1 | 6/2007 | Shimota et al. | |
| 2009/0173204 | A1 | 7/2009 | Malvestiti et al. | |
| 2009/0266209 | A1 | 10/2009 | Thielges et al. | |
| 2010/0107832 | A1 | 5/2010 | Johnston et al. | |
| 2010/0107846 | A1 | 5/2010 | Lee et al. | |
| 2013/0139667 | A1 | 6/2013 | Lee et al. | |
| 2013/0199352 | A1 | 8/2013 | Thielges et al. | |
| 2013/0240615 | A1 | 9/2013 | Thomson | |
| 2013/0319200 | A1 | 12/2013 | Johnston et al. | |
| 2014/0331842 | A1 | 11/2014 | Morehead et al. | |
| 2015/0306651 | A1 | 10/2015 | Rogers | |
| 2015/0367400 | A1 * | 12/2015 | Endo | B21D 28/34 83/698.91 |
| 2016/0228936 | A1 | 8/2016 | Villeneuve et al. | |
| 2016/0332319 | A1 | 11/2016 | Lee et al. | |
| 2016/0339502 | A1 | 11/2016 | Morehead et al. | |
| 2017/0291321 | A1 | 10/2017 | Lee et al. | |
| 2018/0147617 | A1 | 5/2018 | Villeneuve et al. | |

FOREIGN PATENT DOCUMENTS

| | | | |
|---|---|---|---|
| CN | 1080607 | | 3/2002 |
| CN | 1360537 | A | 7/2002 |
| CN | 1524020 | A | 8/2004 |
| CN | 1972767 | A | 5/2007 |
| CN | 101060947 | A | 10/2007 |
| CN | 201127968 | Y | 10/2008 |
| CN | 101791653 | A | 8/2010 |
| CN | 203437498 | U | 2/2014 |
| DE | 1777363 | A1 | 12/1972 |
| DE | 19508091 | C1 | 4/1996 |
| DE | 102006005572 | A1 | 6/2007 |
| EP | 2373442 | A1 | 10/2011 |
| FR | 2641486 | A1 | 7/1990 |
| JP | 62109819 | U | 9/1972 |
| JP | S47-006475 | U | 9/1972 |
| JP | 54059594 | U | 4/1979 |
| JP | S5555877 | A | 4/1980 |
| JP | S5555877 | Y2 | 12/1980 |
| JP | 57189625 | A | 11/1982 |
| JP | 56113039 | U | 2/1983 |
| JP | S58-023221 | U | 2/1983 |
| JP | 5989626 | | 6/1984 |
| JP | S61-22698 | | 2/1986 |
| JP | 6454923 | | 9/1989 |

(56) References Cited

FOREIGN PATENT DOCUMENTS

| | | | |
|---|---|---|---|
| JP | 05192717 | A | 8/1993 |
| JP | 07164070 | A | 6/1995 |
| JP | 3037168 | U | 5/1997 |
| JP | 09174162 | A | 7/1997 |
| JP | 10244327 | A | 9/1998 |
| JP | 10244331 | A | 9/1998 |
| JP | 11151533 | A | 6/1999 |
| JP | 2000317551 | A | 11/2000 |
| JP | 2001137970 | A | 5/2001 |
| JP | 2002011531 | A | 1/2002 |
| JP | 2002282962 | A | 10/2002 |
| JP | 2004500242 | A | 1/2004 |
| JP | 2006110605 | A | 4/2006 |
| JP | 2006150392 | A | 6/2006 |
| JP | 2006297466 | A | 11/2006 |
| JP | 2007136463 | A | 6/2007 |
| JP | 2007160384 | A | 6/2007 |
| JP | 2008183576 | A | 8/2008 |
| JP | 5555877 | B2 | 7/2014 |
| WO | 2004024361 | | 3/2004 |
| WO | 2004060620 | A2 | 7/2004 |
| WO | 2010053895 | A1 | 5/2010 |
| WO | 2010053897 | A1 | 5/2010 |
| WO | 2013070536 | A1 | 5/2013 |
| WO | 2013116886 | | 8/2013 |
| WO | 2016130351 | A1 | 8/2016 |
| WO | 2016130530 | A1 | 8/2016 |

OTHER PUBLICATIONS

Applicant Interview Summary and Response to Non-Final Office Action for U.S. Appl. No. 13/708,318, filed Jul. 28, 2017 (16 pages).
Applicant-Initiated Interview Summary for U.S. Appl. No. 13/708,318, dated Jul. 21, 2017 (3 pages).
Applicant-Initiated Interview Summary for U.S. Appl. No. 15/204,248, dated Apr. 21, 2017 (3 pages).
Final Office Action for U.S. Appl. No. 15/204,248, dated Mar. 24, 2017 (9 pages).
International Preliminary Report on Patentability for International Patent Application No. PCT/US2012/063505, dated May 13, 2014 (7 pages).
International Search Report and Written Opinion of the International Searching Authority for International Patent Application No. PCT/US2009/063058, dated Feb. 17, 2010 (10 pages).
International Search Report and Written Opinion of the International Searching Authority for International Patent Application No. PCT/US2009/063062, dated Feb. 17, 2010 (11 pages).
International Search Report and Written Opinion of the International Searching Authority for International Patent Application No. PCT/US2012/063505, dated Jan. 4, 2013 (11 pages).
Non-Final Office Action for U.S. Appl. No. 13/708,318, dated Mar. 31, 2017 (10 pages).
Non-Final Office Action for U.S. Appl. No. 15/204,248, dated Nov. 23, 2016 (11 pages).
Non-Final Office Action for U.S. Appl. No. 15/631,435, dated Jul. 13, 2017 (9 pages).
Notice of Allowance for U.S. Appl. No. 13/708,318, dated Aug. 21, 2017 (8 pages).
Notice of Allowance for U.S. Appl. No. 15/204,248, dated May 12, 2017 (8 pages).
Response to Non-Final Office Action for U.S. Appl. No. 15/204,248, filed Dec. 16, 2016 (15 pages).
Written Opinion of the International Preliminary Examining Authority for International Patent Application No. PCT/US2016/017129, dated Jan. 17, 2017 (6 pages).
Written Opinion of the International Preliminary Examining Authority for International Patent Application No. PCT/US2016/015940, dated Jan. 17, 2017 (7 pages).
First Office Action for Chinese Patent Application No. 201680020757.4, dated Nov. 22, 2018 (4 pages).
First Office Action for Japanese Patent Application No. 2017-560469 dated Jan. 8, 2019 (4 pages).

* cited by examiner

10

A
12
68
64
65
14T
14

10
12
62
42
49
60
45
14T
64
65
14

FIG. 10B
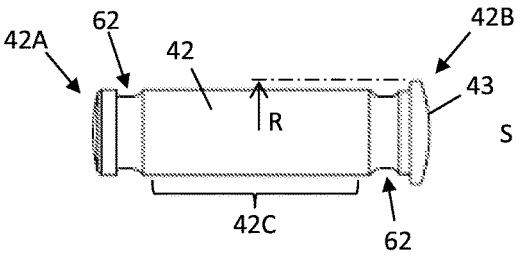
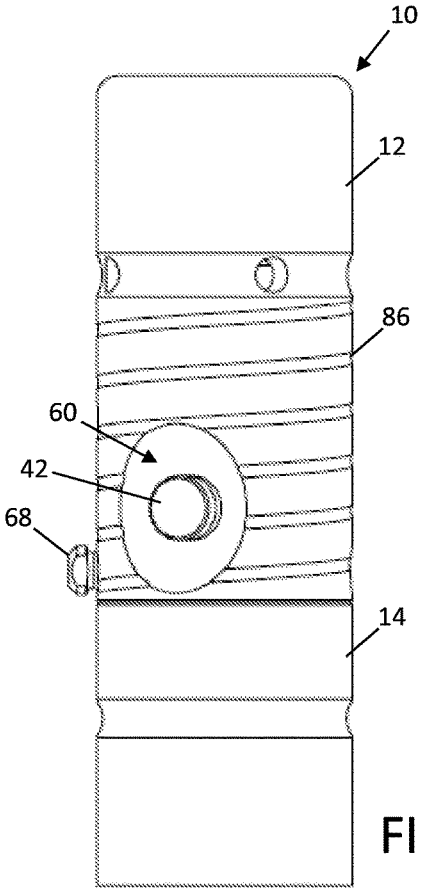
FIG. 10C
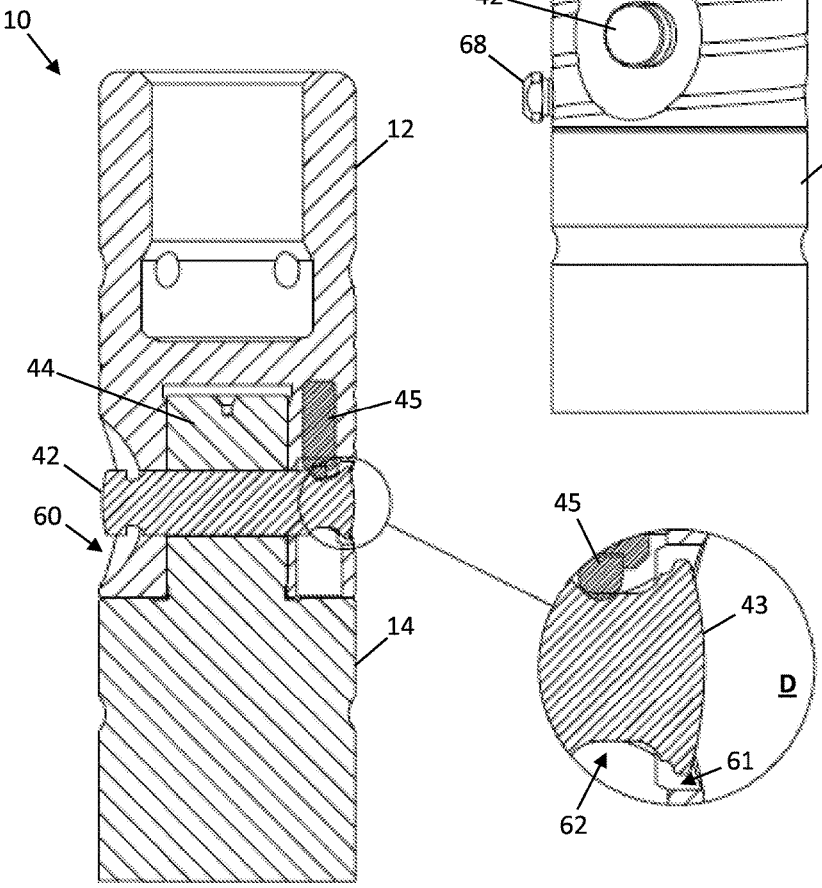
FIG. 10A

PUNCH ASSEMBLY WITH REPLACEABLE PUNCH TIP SECURED BY COUPLING PIN

CROSS-REFERENCE TO RELATED APPLICATIONS

This application claims priority to U.S. Provisional Application No. 62/113,778, filed Feb. 9, 2015, entitled PUNCH ASSEMBLY WITH REPLACEABLE PUNCH TIP, which is incorporated by reference herein, in the entirety and for all purposes. This application is related to copending U.S. patent application Ser. No. 14/985,863, entitled PUNCH ASSEMBLY WITH REPLACEABLE PUNCH TIP, filed Dec. 31, 2015, which is incorporated by reference herein, in the entirety and for all purposes.

BACKGROUND

This disclosure relates generally to machine tools, and specifically to punch assemblies for metal working. In particular, the disclosure relates to punch tool assemblies suitable for use in punch press machines, including, but not limited to, high speed punch presses used in fabrication and manufacturing.

Industrial tooling machines including turret and rail-type punch presses are widely used in the fabrication of sheet metal workpieces and other sheet components (e.g., metal, plastic, leather, etc.). Automated punch presses are commonly employed in manufacturing applications, including single and multi-station presses, press brakes, sheet and coil feed systems, rail-type machine tool systems, and other fabrication equipment adapted for pressing, bending and punching sheet metal components, used to fabricate sheet metal and other workpieces into a wide range of useful products.

Punch presses in particular have found wide use in sheet metal hole punching and forming applications. Turret presses typically have an upper and lower turret sections that hold a series of punches and dies, spaced circumferentially at different locations around the periphery of the turret. The turret press can then be rotated about a vertical axis to bring a desired punch and die set into vertical alignment with a work station, or to bring a series of different punch and die sets sequentially into alignment for performing a series of different pressing operations. Rail-type and single-tool punch presses are also widely used.

The workpiece itself is commonly formed of a piece of sheet metal, disposed between selected punch and die combinations. The punches can be operated under computer control, when the selected punch and die assemblies are aligned across the workpiece. The punch is driven through the workpiece and into the die, forming a hole or other desired feature.

Punch systems typically include an outer punch guide with a punch member reciprocating in a longitudinal bore, or a punch ram assembly with a bushing to hold the punch. The punch itself typically includes a shank or body portion and a punch point or other forming tool on the working end, facing the sheet metal component or workpiece. The punch point engages the workpiece in the punch stroke, forming a hole by driving a slug out of the workpiece metal and through the die. A return spring or punch clamp can be used to urge the punch back into its original position, in a stripping action following the punch stroke.

A high number of repeated strokes are typical in automated machine tool applications. The punch point may thus become worn, and require sharpening or replacement. There is a constant need to make the replacement process less complex and more efficient, with less downtime and reduced replacement cost.

SUMMARY

A punch or punch device assembly is provided, suitable for use in a punch press or similar tooling machine. The assembly includes a replaceable punch tip configured for selective engagement and disengagement with a punch body. Punch press systems using the punch assembly are also encompassed, along with corresponding methods of assembly and operation.

Depending on configuration, the punch body and punch tip can be coupled by axial engagement between an insert or stem and a corresponding axial cavity. Various manual and tool-less coupling mechanisms may be utilized e.g., with a transverse coupling pin engagement between the punch body and stem.

BRIEF DESCRIPTION OF THE DRAWINGS

FIG. 10A is a section view of the punch assembly with a head on the coupling pin to prevent dual direction actuation.

FIG. 10B is a side view of a coupling pin for the assembly of FIG. 10A.

FIG. 10C is a side view of a pin-coupled punch assembly with a spiral lubrication groove.

DETAILED DESCRIPTION

Figure 1:
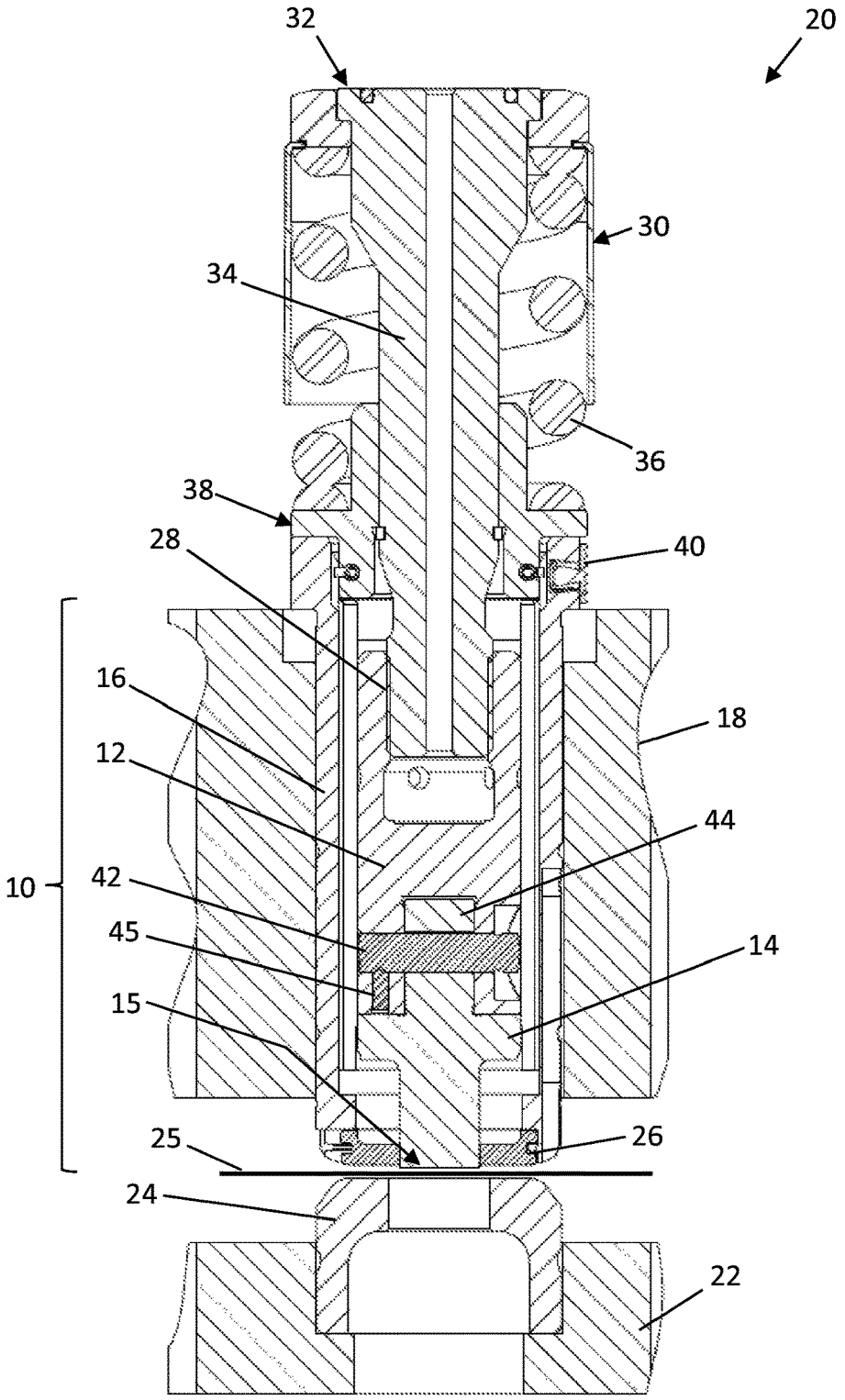
FIG. 1 is a section view of a punch assembly with replaceable punch tip, in a turret-type punch press.

FIG. 1 is a section view of punch assembly 10 with punch body 12 and a replaceable punch tip 14, terminating in punch point 15. In this particular example, punch assembly 10 is disposed within a bushing or punch guide 16, installed in upper turret 18 of punch press apparatus 20.

Punch press apparatus 20 includes upper turret 18 and lower turret 22. Die 24 is mounted in lower turret 22, opposite punch tip 14 across workpiece 25, for example a sheet metal component or other material to be tooled.

In operation of punch assembly (or punch) 10, punch point 15 of punch tip 14 is driven through an aperture in stripper 26 on the bottom surface of punch guide 16, extending through workpiece 25 and into die 24. Punch point 15 separates a slug from workpiece 25 during the punching process, and the slug is received into die 24. Stripper 26 is disposed on the bottom surface of punch guide 16, and holds workpiece 25 in place as punch point 15 is withdrawn from die 24. Alternatively, press apparatus 20 and die 24 may be configured for notching, slitting, shearing, or blanking workpiece 25, or for other metal forming processes.

A threaded connection or other mechanical coupling 28 couples punch body 12 to punch canister assembly 30, with punch head 32, punch driver 34 and stripping spring 36. A ram component of punch press apparatus 20 imparts an axial (e.g., downward) force onto punch head 32, driving punch driver 34 through an aperture in spring retainer plate 38 by a distance sufficient for punch point 15 to penetrate workpiece 25 into die 24, as described above. When the ram is retracted (or the driving force on the ram is removed), stripping spring 36 acts between spring retainer plate 38 and punch head 32, moving punch driver 34 back (e.g., upward) to its original position. Punch tip 14 is withdrawn from die 24 and workpiece 25 back into punch guide 16, with punch point 15 positioned within (and no longer extending from) the aperture in stripper member 26, as shown in FIG. 1.

Depending on embodiment, a pushbutton or other mechanism 40 may be provided to adjust punch length of punch assembly 10, as measured to punch tip 14 and punch point 15. Additional features suitable for application in punch press apparatus 20 are disclosed in U.S. Pat. Nos. 5,839,341, 5,884,544, and 7,975,587, currently assigned to Mate Precision Tooling of Anoka, Minn., each of which is incorporated by reference herein, in the entirety and for all purposes.

FIG. 1 illustrates a two-part punch configuration, in which a removable and replaceable lower portion or punch tip 14 of punch assembly 10 is coupled to the upper portion or punch body 12. Small, replaceable punch tips 14 can be made from high performance tool steel and other suitable materials at relatively low cost, and changed in and out when worn, or when a new punch tip configuration is desired. Replaceable punch tips 14 can also be configured for toolless manual operation, so that they can be removed, exchanged and locked back into place manually and without special tools, or without any tools at all, as described herein.

In one particular example, punch tip 14 is secured to punch body 12 using a pin-connected configuration, as shown in FIG. 1, with replaceable punch tip 14 secured by a sliding engagement pin 42 held in place by a resilient ball plunger 45 or similar retention mechanism, and positioned through punch body 12 and tang or stem 44 of punch tip 14. Alternatively, the punch tip can be secured with a pivot latch mechanism, e.g., as described in copending U.S. patent application Ser. No. 14/985,863.

Figure 2:
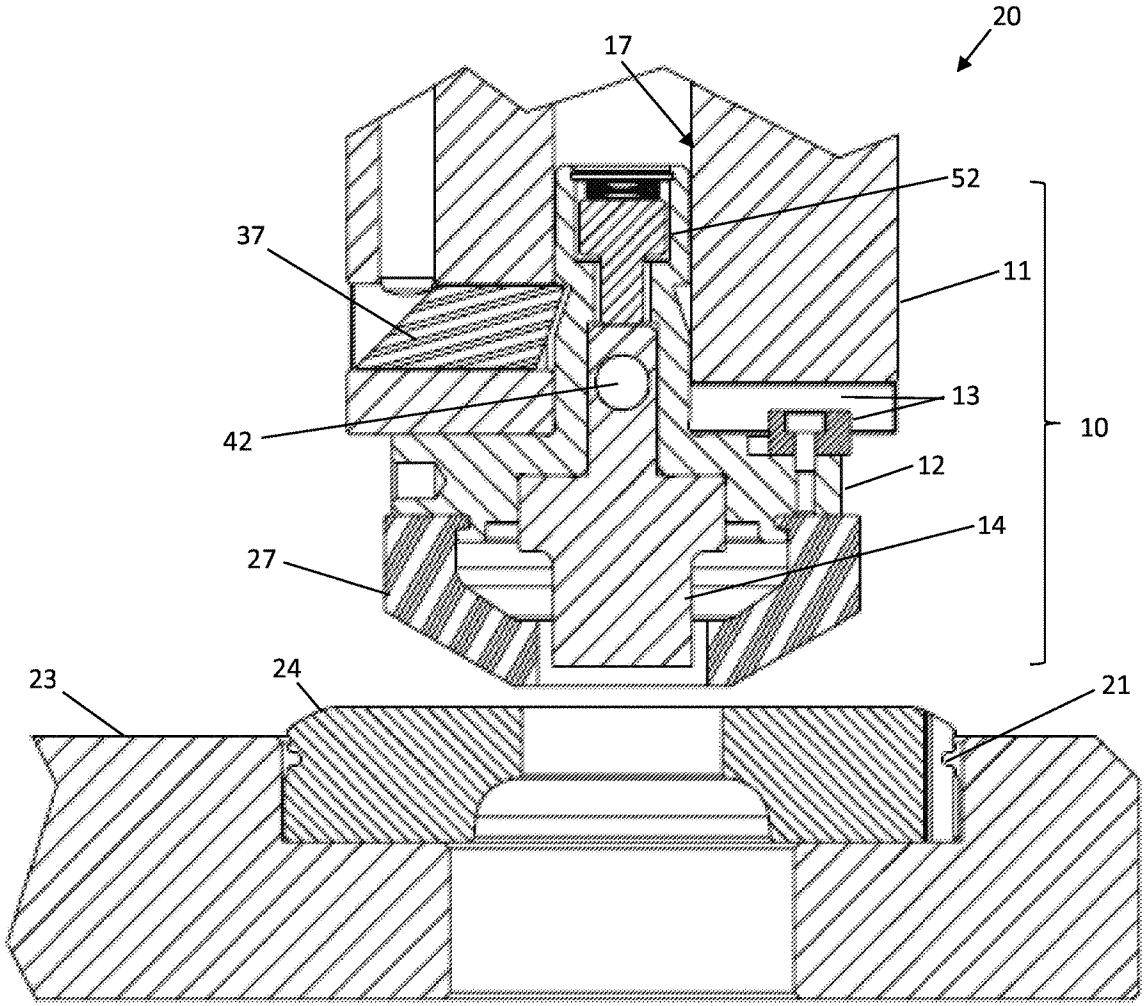
FIG. 2 is a section view of a punch assembly with replaceable punch tip, in a single tool or rail-type punch press.

FIG. 2 is a section view of punch assembly (or punch) 10 with replaceable punch tip 14, in single-tool or rail-type press apparatus 20. In this configuration, punch assembly 10 is mounted in press ram assembly 11, and a threaded coupling to a punch canister is not necessarily required. Instead, press ram assembly 11 includes an internal bushing 17 or similar structure configured to retain punch body 12 and punch tip 14 in vertical alignment along the punch axis. Both punch assembly 10 and die 24 can be provided with angular keying, for example punch keying 13 and die keying 21.

In punching operation, press ram 11 is actuated to drive the working end of the punch tip or insert 14 through the workpiece, and into engagement with die 24 in die holder 23. In the rail-type configuration of FIG. 2, punch press apparatus 20 may utilize a urethane stripper member 27, with punch tang clamp 37 configured to apply the stripping force when punch tip 14 is withdrawn from die 24. Additional features suitable for application in such a punch press apparatus 20 are disclosed in U.S. Pat. No. 4,951,375, which is incorporated by reference herein, in the entirety and for all purposes.

In one particular example, punch tip 14 is secured to punch body 12 using coupling pin 42, as shown in FIG. 2. A vertical spring or similar ejector 52 is disposed within punch body 12. Ejector 52 is configured to urge punch tip 14 out of axial engagement with punch body 12, when punch assembly 10 is removed from punch press apparatus 20 and coupling pin 42 is manipulated from the inserted or engaged position to a disengaged position. Alternatively, a pivot latch-type mechanism or other coupling structure can be utilized, e.g., as described in the related patent applications incorporated by reference above.

Replaceable Punch Tip Secured with Slide-in Coupling Pin

Figure 3A:
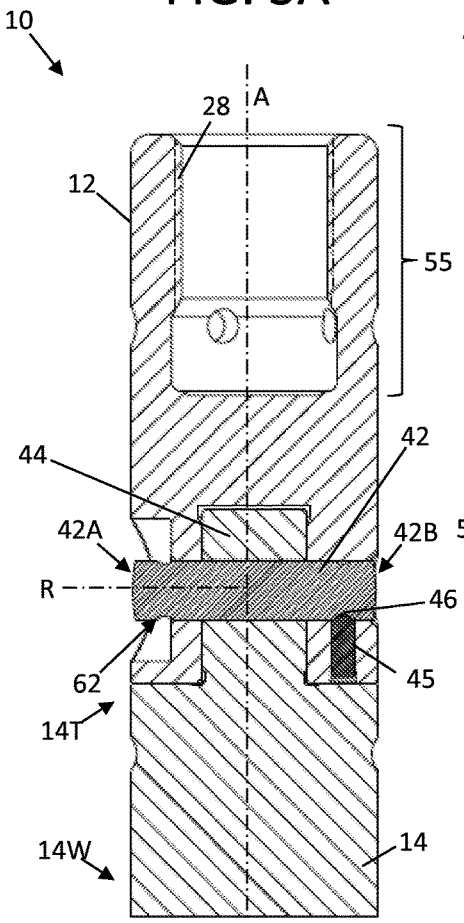
FIGS. 3A and 3B are section views of a punch assembly with a pin-connected punch tip coupling, shown with the punch tip in engaged and disengaged positions, respectively.

FIG. 3A is a section view of punch assembly 10, in a pin-connected punch tip configuration with replaceable punch tip 14 secured via a slide-in (or sliding) pin 42. In this view, pin 42 is shown in a closed or engaged position, with ball 46 of ball plunger 45 holding pin 42 resiliently in place.

Figure 3B:
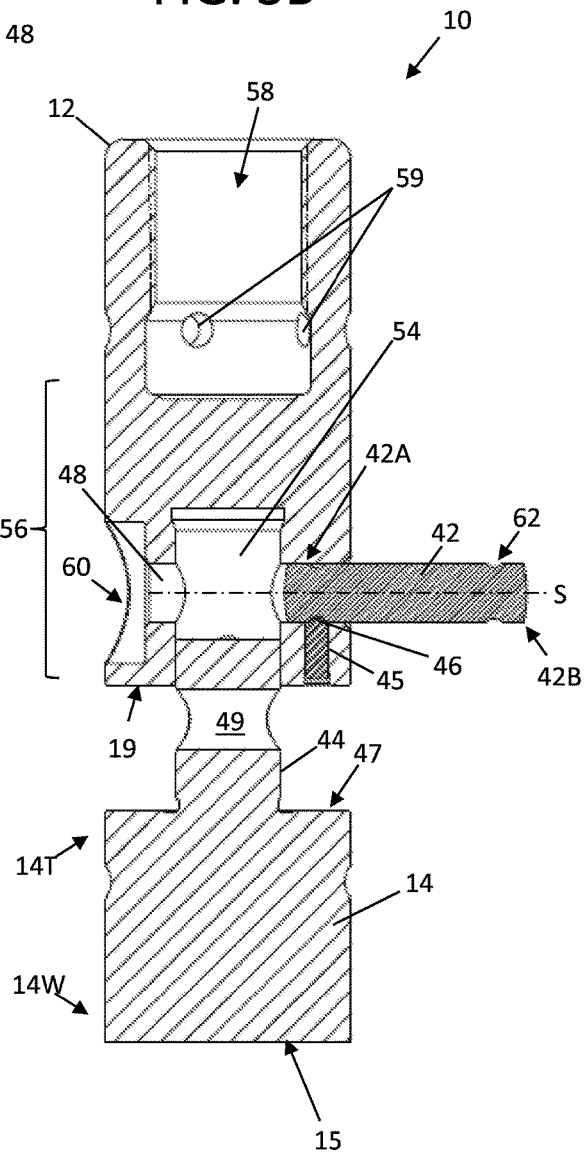

FIG. 3B is an alternate section view of punch assembly 10. In this view, pin 42 is held in an open position, via ball 46 of ball plunger 45.

Removable tip punch assembly 10 is configured for punch press tooling, and includes a removable lower punch tip 14 for a punch press machine, held into an upper portion or punch body 12 by a manually operable lateral sliding pin 42. Replaceable punch tip 14 is locked in place securely without elastic or cam features, and pin 42 is easily operated without tools. A variety of small, removable and replaceable punch tips 14 can be made from high performance tool steel and other suitable materials, at comparatively low cost.

This design incorporates a number of useful features, not previously found in the punch press industry. These features include radial sliding pin 42, which is configured to engage tang or stem portion 44 of punch tip 14 and the lower portion of punch body 12, extending through radially aligned (e.g., cylindrical) walls of cavities 48. Pin 42 is aligned with and positioned through radial cavities or bores 48 and 49 (see FIG. 3B) to secure punch tip 14 to punch body 12 for punching, as shown in FIG. 3A. The pin and radial cavity alignment can also act as a precision axial rotational feature for punch assembly 10, by machining radially aligned cavities 48 into the walls of punch body 12 with the corresponding desired precision.

Description of Operation and Functions

Punch assembly or device 10 includes a removable punch tip 14 attached to a specially configured "holder" or punch body 12, which makes up the remainder of what would otherwise be a complete punch (or punch assembly) 10, which in turn is used in a punch press. Such a removable punch tip 14 is desirable in the industry, because, for example, if punch tip 14 is very small (or relatively small, as compared to the other components of punch assembly 10), punch tip 14 can be made of high performance material at a reasonable cost, while lower-cost materials are used for other components (e.g., punch body 12), whereas making the entire punch 10 of such high-performance materials could be cost-prohibitive.

Punch device or assembly 10 includes three working elements. These are punch tip 14, punch body 12, and the punch tip retention mechanism of coupling pin 42.

Punch Tip

In preferred embodiments, punch tip 14 encompasses the removable lower portion of punch assembly 10, and has a cylindrical shank, tang or stem 44 extending at top end 14T, opposite working end 14W of punch tip 14 (e.g., punch point 15, see FIG. 1). The diameter of stem 44 can be smaller than the outside diameter of punch tip 14. Thus, a ledge or flange 47 is provided for mating punch tip 14 with lower surface 19 of punch body 12, and for transferring load between punch body 12 and punch tip 14 during operation of punch assembly 10. Stem 44 includes a radial cylindrical cavity 49 configured to accept a sliding pin 42, providing an axial securing element configured to secure punch tip 14 to punch body 12. Working end 14W of punch tip 14 can be configured in the same or similar form as that of a complete one-piece punch device, where the punch point is either round or shaped to form or punch a desired configuration in a particular working piece, such as a sheet metal material or other material to be punched.

Figure 5A:
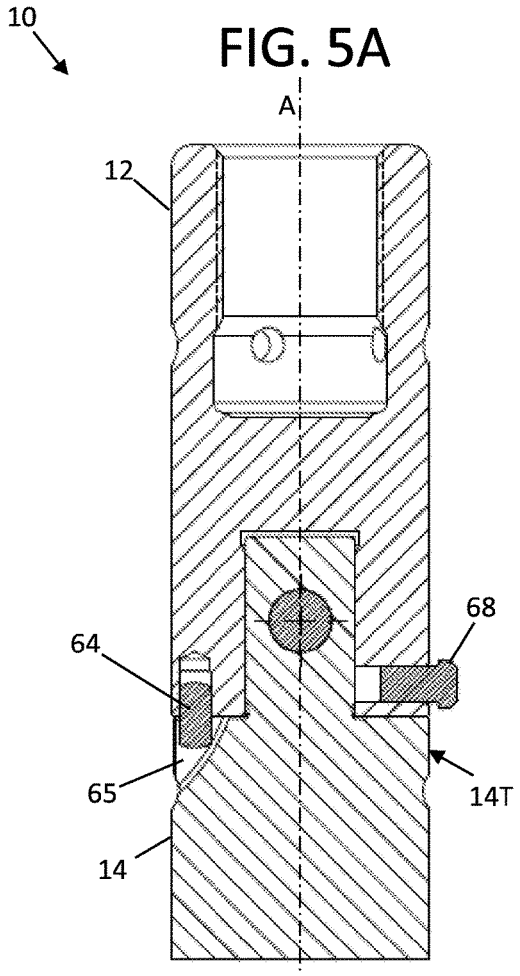
FIGS. 5A and 5B are section and side views of the punch assembly, illustrating precision angular connection and alignment features.
Figure 5B:
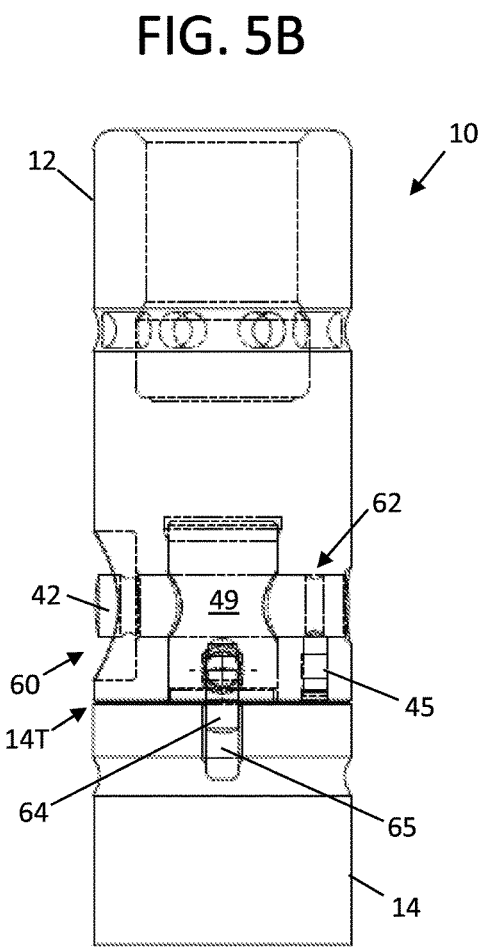

In additional embodiments, an alignment pin 64 in punch body 12 and mating alignment slot 65 in the flange or top end 14T of punch tip 14 allow for precision orientation of punch tip 14 with respect to punch body 12, suitable for practical application in a punch press apparatus (see, e.g., FIGS. 5A and 5B). The outside diameter of punch tip 14 may also be machined with high precision to properly center punch tip 14 with respect to a punch guide or bushing, or made smaller to provide clearance between punch tip 14 and the punch guide or bushing, and allow centering via precise fit between punch tip tang or stem 44 and the axially centered bottom pocket or cavity 54 in punch body 12 as shown in FIG. 3B, providing the precision centering. A smaller outside diameter on punch tip 14 may have advantages, e.g., not needing additional porting for lubrication flow down to punch tip 15.

Alternately, it may be desirable to include both mechanisms, in a redundant centering system with both constraints. Precision centering is desired to reduce damage to the die, e.g., when punching thin materials that require a tight fit between the punch and die sizes.

Punch Body

In preferred embodiments, punch body 12 (FIG. 3A) has a threaded coupling 28 or similar coupling feature on upper receiving end 55, above lower end 56, e.g., in threaded cavity 58 with radial lubrication passageways 59 (FIG. 3B). Coupling 28 is configured for attachment of punch 10 to other punch press components, and for length adjustment. A radial protruding orientation key 68 can also be provided (FIG. 5A), for angular orientation of punch body 12 and punch tip 14 by keying into a punch guide 16 (FIG. 1) or bushing 17 (FIG. 2).

Punch body 12 has an axial (e.g., cylindrical) pocket or cavity 54 on lower end 56, configured for receiving the axial tang or stem 44 of punch tip 14. Pocket or axial cavity 54 can be precisely centered to facilitate accurate location of punch tip 14. An alignment pin 64 may also be provided at the bottom end of punch body 12, oriented parallel to punch axis A but centered near the outer diameter, and configured to angularly orient punch tip 14 with respect to punch body 12 by engaging a precision key-slot 65 in punch tip 14.

For tool-less manual operation of coupling pin 42, a relief cavity 60 (FIG. 4A) may be provided in the outside wall of punch body 12 on either or both ends of radial passages or pin receiving cavities 48 and 49 (FIG. 4B); e.g. a flat bottom cavity 60 (FIG. 4A) or a curved or angled relief cavity 60 (FIG. 6B) which is significantly larger in the transverse direction than pin 42. Relief cavity 60 is configured for manually pushing pin 42 inward into pin passage or cavity 48 on one side of punch body 12 to begin disengagement of pin from cavity 49 in punch tip stem 44 of punch tip 14, and to allow removal of punch tip 14 from punch body 12.

Further enhancements encompass ergonomic knurls or grooves configured to facilitate gripping and manipulation of pin 42. A ball plunger 45 may also be pressed or screwed into a hole in punch body 12, e.g., substantially perpendicular to radial axis S of pin 42 (FIG. 3B), and configured to engage with detents or grooves 62 in pin 42, in order to urge pin 42 into either the engaged (locked) or disengaged (unlocked) position with respect to punch tip stem 44, as described below.

Sliding Pin

In preferred embodiments (e.g., as shown in FIGS. 3A-B and 4A-B), sliding pin 42 is configured as a simple cylindrical pin with grooves or detents 62 positioned for capturing and retaining pin 42 in selected positions in punch assembly 10. Alternately, pin 42 could have any particular shape, as long as receiving channels or cavities 48 (in punch body 12) and 49 (in punch tip stem 44) are shaped in a complementary fashion, with suitable tolerance. Pin 42 has a first end 42A which is pushed in to begin the release process of punch tip 14. Pin 42 has a second end 42B which can then be pulled laterally or radially outward until pin 42 reaches a stopping point where groove 62 engages ball 46 of ball plunger 45. When pin 42 is in the inner or locked (engaged) position, the middle section of pin 42 (between grooves 62) engages receiving cavities 48 and 49 of punch body 12 and punch tip 14. In the outer or open (disengaged) position, pin 42 is disengaged from cavity 49 in punch tip stem 44 and first end 42A of pin 42 engages only (one) radial cavity 48 in punch body 12.

Radial grooves, detents, or other engagement features 62 can also be provided on sliding pin 42, e.g., positioned towards opposite ends 42A and 42B, as shown in FIGS. 3A and 3B. Detents or groove engagements 62 are configured to engage ball plunger 45, or a similar retention mechanism, in order to resiliently hold pin 42 in the alternate open and closed positions. Various other ways of retaining pin 42 or urging pin 42 into the alternate open and closed positions are described in the examples below.

Installation of Punch Tip into Punch Body

Figure 4A:
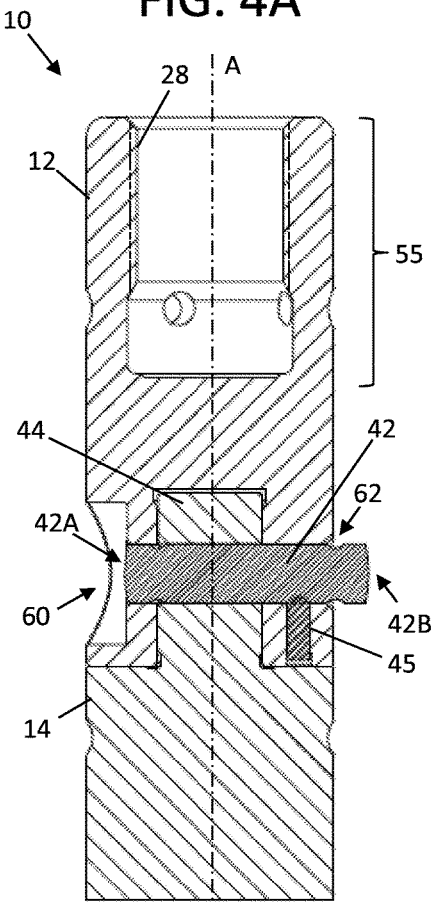
FIGS. 4A and 4B are section views of the punch assembly, showing the coupling pin in engaged and disengaged positions.

FIG. 4A is a section view showing the pin-connected punch assembly of FIG. 3A. In this view, one end 42A of pin 42 is shown pushed out of relief cavity 60, which begins the process of releasing punch tip 14 from punch body 12. Thus the opposite end 42B is pushed out of punch body 12, and positioned to be manually grabbed or manipulated.

Figure 4B:
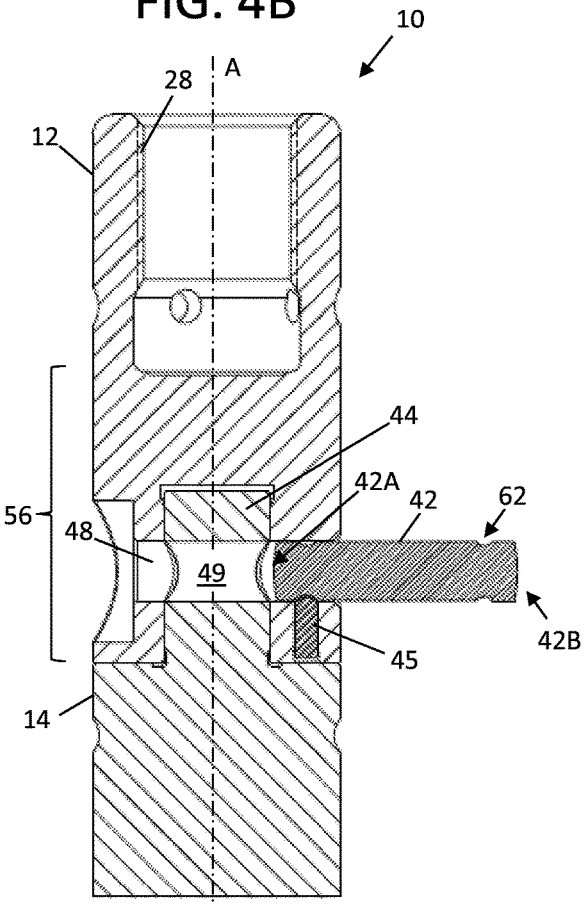

FIG. 4B is an alternate section view of the punch assembly in FIG. 3A. In this view, pin 42 is pulled outward to the open position, resiliently held in place by ball plunger 45.

In preferred embodiments, punch assembly 10 encompasses a premium adjustable-length punch system with a threaded engagement or similar coupling feature 28 in top portion 55 of punch body 12, and a vertical hole or axial cavity 54 in the lower end or bottom portion 56 (see FIG. 3B), configured for accepting precision tang or stem 44 of punch tip 14. Punch body 12 also has features configured to accept pin 42, fitting into the horizontal hole formed by radial cavity 49 in stem 44 of punch tip 14, when punch tip 14 is installed onto punch body 12.

Pin 42 can be manipulated laterally inward to fit into a locked position within receiving cavities 48 and 49 of punch body 12 and punch tip 14, constraining punch body 12 and punch tip 14 to move slidably together within the punch guide or bushing. Pin 42 can also be manipulated into a laterally outward or open position in which stem 44 of punch tip 14 can move vertically or axially past pin 42, facilitating installation or removal of punch tip 14.

Punch tip 14 is resiliently locked in place for punching operation when pin 42 is fully inserted through cavities or channels 48, 49, positioned within or at least flush with the outside diameter of punch body 42. Pin 42 can be further secured in the locked position when punch assembly 10 is installed within the walls of a punch guide, bushing, or similar component, where the walls constrain pin 42 in the axial direction and prevent or do not allow for pin 42 to slip out of (or extend beyond the sides of) punch body 12. Pin 42 can further be constrained by a resilient or secured coupling or other various mechanical features, as described in the examples below, in order for pin 42 to remain in either the locked or open positions, and to facilitate or ease manual operation of the sliding pin mechanism.

Once punch tip 14 is completely pushed into the axial cavity in punch body 12, radial sliding pin 42 can be pushed or manipulated by hand from its "open" position through the corresponding radial cavity or channel 49 in punch tip (or insert) stem 44. Pin 42 can then be snapped into place in the "closed" position, when the corresponding radial groove or other engagement feature 62 meets ball plunger 45. Punch tip 14 can thus be alternately retained and released by manually operable pin 42.

Punch tip 14 may also be provided with keying for angular orientation. For example, an axially oriented pin or key can be provided at a radial distance from punch body axis A, which fits into a slot or cavity in punch tip 14. This positions punch tip 14 angularly, in a predetermined or selected rotational alignment with respect to punch body 12.

Removal of Punch Tip from Punch Body

To remove punch tip 14 from punch body 12, punch assembly 10 can be removed from the punch guide and separated into two or more parts by moving pin 42 to the open or disengaged position. This can be performed in a two-part process, in which a first end of pin 42 is first pushed into a relief cavity 60 on one side of punch body 12, allowing pin 42 to move into punch body 12 enough for the second (opposite) end of pin 42 to protrude from the outside diameter of punch body 12 on the opposite side. Then, pin 42 can be manually grabbed or manipulated on the second end (e.g., with a finger and a thumb), and pulled outward from punch body 12 until the second end of pin 42 reaches an outer lateral location and the groove or engagement feature 62 on the first end of pin engages ball plunger 45.

When the second end of pin 42 reaches the proper location, pin 42 snaps or locks in the open position, allowing punch tip 14 to be manually removed or pulled out of punch body 12 (e.g., using the other hand to slide tip stem 44 or punch tip 14 axially, out of cavity 54 in punch body 12). Depending on design, pin 42 may also be configured for manipulation past the open position, and removal from punch body 12.

FIG. 5A is a section view of punch assembly 10, illustrating precision angular connection and alignment features. As shown in FIG. 5A, a dowel or alignment pin 64 extends from an axially oriented hole in punch body 12, and is aligned with a corresponding curved or angled slot 65 in replaceable punch tip 14. A key 68 is also provided, and configured to engage a corresponding axial slot or similar alignment feature on the inner surface of the punch guide or bushing.

FIG. 5B is a side view of punch assembly 10 as shown in FIG. 5A, illustrating the precision angular connection between punch body 12 and punch tip 14. In preferred embodiments, e.g., before completely inserting punch tip 14 into punch body 12, punch tip 14 is rotated until precision orientation slot 65 is positioned to engage axially oriented alignment pin 64. Alignment pin 64 is positioned a selected radial distance from center axis A of punch body 12, extending from the bottom surface of punch body 12 into precision slot 65 of punch tip 14 as shown in FIG. 5B.

As can be seen in the various section views of punch assembly 10, stem or tang 44 of punch tip 14 may have radial cavity or channel 49 (e.g., cylindrical and perpendicular to the punch axis), which accepts pin 42 to secure punch tip 14 to punch body 12.

When pin 42 is completely inserted into punch body 12, with pin 42 fully engaged with the corresponding cavity or channel 49 in the punch tip or punch insert (e.g., in tang 44), pin 42 is in the installed or closed and locked position. When pin 42 is manipulated to extend from the outer circumference of punch body 12 at one end, with the other end radially outside cavity or channel 49 in punch tip 14 and positioned to engage with ball plunger 45 via a groove or similar feature, pin 42 is considered to be in the open or assembly (unlocked) position. This mechanism allows employment of a relatively small punch tip 14, which can be easily installed onto or removed from punch body 12 manually, without the need for specialized tools, and without necessarily requiring tools of any kind.

Figure 6A:
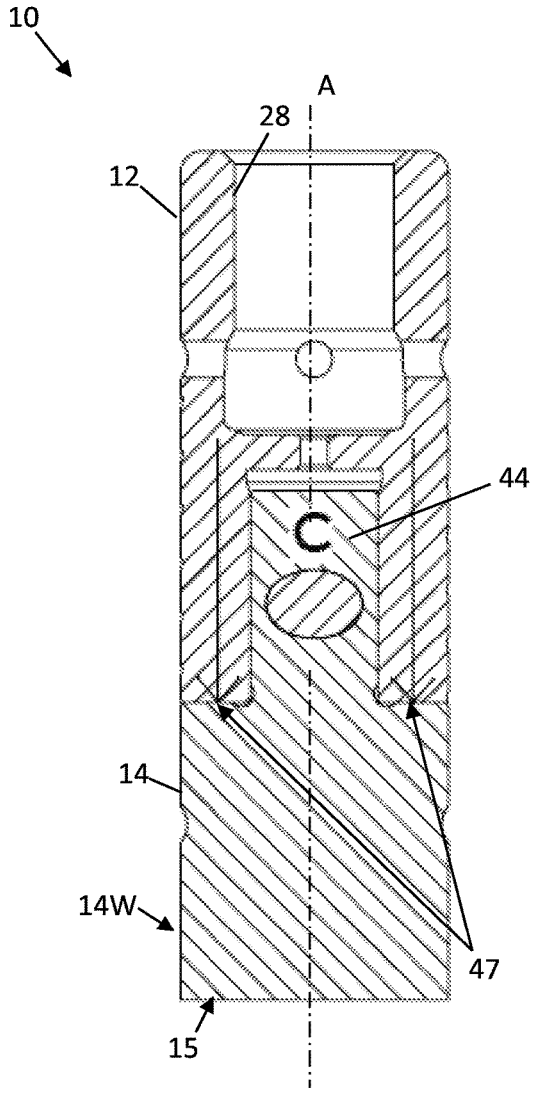
FIGS. 6A and 6B are section views of the punch assembly, illustrating compression and strip loading force diagrams.
Figure 6B:
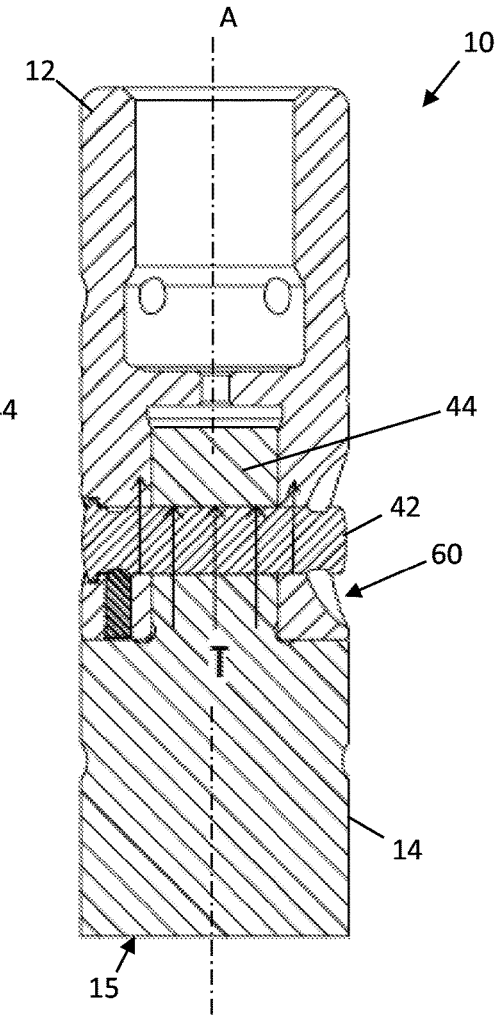

FIG. 6A is a section view of the punch assembly, illustrating the compression loading. FIG. 6B is a section view of the punch assembly in FIG. 6A, illustrating the strip (punch retraction) loading.

As shown in FIG. 6A, the force required to perform a punch operation flows axially from (e.g., threaded) coupling 28 at the top of punch device 10, down through the punch driver and punch body 12 and across flange 47 to punch point 15 on working end 14W of punch tip 14. As punch assembly 10 travels downward to punch a hole in the sheet material or workpiece, the workpiece pushes back upward against punch point 15, introducing a substantial compressive loading C (downward arrows) between punch tip 14 and punch body 12. The punch loading can easily exceed several tons, depending on punch size and the working material composition and thickness.

To avoid damage or deformation of coupling pin 42 during the punch stroke, the compressive loading may be directed to the contact surfaces defined between punch body 12 and punch tip 14, for example by maintaining clearance between the coupling pin and pin cavity, or other relevant coupling structures. Thus, the load may be directed to the interface between the top surface of the flange or ledge 47, extending circumferentially about stem 44 on punch tip 14, and on the bottom surface of punch body 12, extending around the axial cavity in which stem 44 is engaged. Note that there may be some gaps along the load-bearing surfaces (e.g., due to the alignment features), but these are typically small in relation to the load-bearing surface area, in order to maintain the strength and integrity of punch device 10.

There is also loading during the stripping operation, due to punch point 15 sticking in the sheet when punch tip 14 is retracted due to the material around the circumference of the punch hole tending to grip punch point 15. This results in a tension load T on punch body 12 and sliding pin connector 42, rather than a compressive load and the magnitude of tension load T (upward arrows) during the stripping operation is typically several times less than that of compressive loading C during the punch stroke. Nonetheless, the stripping loads can be extensive, and the corresponding tension forces must be transferred through the coupling between punch tip stem 44 and pin 42, as shown in FIG. 6B.

To address these very different punching and stripping loads, punch 10 must provide a combination of compressive loading surfaces defined across punch axis A, along the contact interface between punch body 12 and punch tip 14, and a coupling mechanism with sufficient strength to withstand the smaller but still very substantial tension loads introduced along axis A, when punch point 15 is withdrawn from the sheet metal workpiece. In this particular embodiment, this means that coupling pin 42 and punch tip stem 44 are configured to maintain the coupling between punch body 12 and punch tip 14 under a tension loading on the order of at least a few tons, or more. The coupling and load-transfer structures should also be configured to withstand these different compression and tension loads over extended period of operation, including many thousands or even millions of punch cycles, executed over weeks and months of continuous operation, and years of accumulated service time.

Figure 7A:
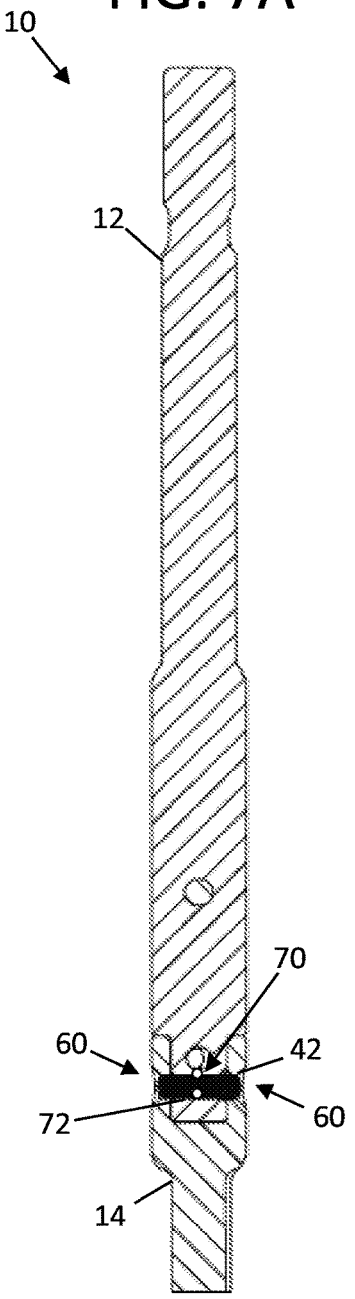
FIGS. 7A and 7B are section views of the punch assembly adapted for different punch station sizes, with cavity and stem reversed and a resilient retention element on the coupling pin.
Figure 7B:
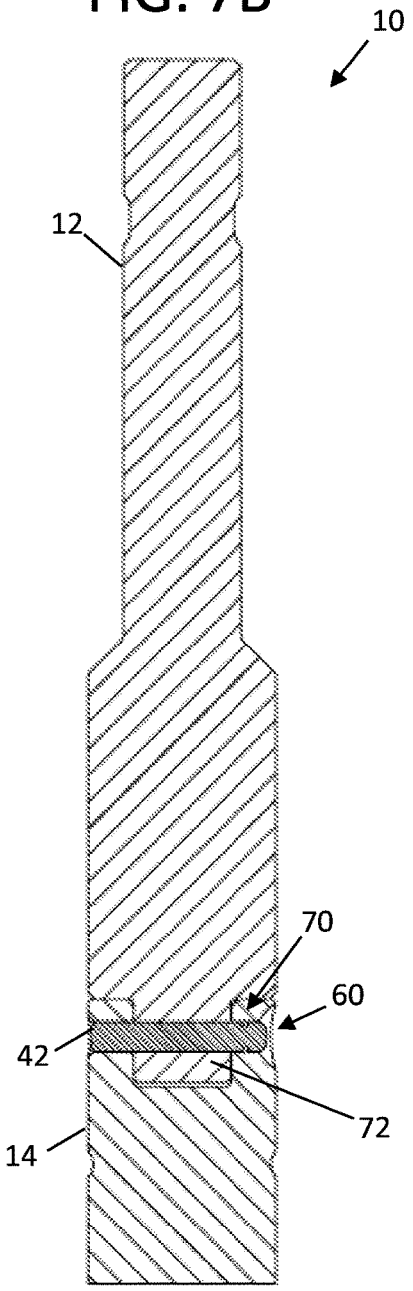

FIGS. 7A and 7B are section views of punch assembly 10, in different, longer-style configurations with a relatively smaller diameter in FIG. 7A, and relatively larger diameter in FIG. 7B. A resilient pin retention element 70 is configured to retain pin 42 in position by resilient friction, rather than using a ball and plunger.

FIGS. 7A and 7B also show a different axial coupling design, in which punch tip 14 is provided with an axial cavity configured to receive a complementary axial stem or tang structure 72 protruding from the bottom of punch body 12. The interconnection of punch tip 14 and punch body 12 is thus reversed, such that punch body 12 has the protruding tang 72, and punch tip 14 has the cavity. Relief cavities 60 can also be provide on one or both sides of punch tip 14, in order to manipulate pin 42 between the open (decoupled) and closed (locked or coupled) positions.

In additional embodiments, pin 42 can be resiliently held in place with one or more rubber or polymer rings 70 (e.g., O-rings or other resilient members), disposed in radial grooves extending circumferentially about pin 42. Additional grooves can be added to the axial holes in punch body 12 (or to the radial grooves or channels extending through stem 72, and/or the outer walls of punch tip 14), in order to provide additional resistance for retaining pin 42 by engaging resilient ring members 70 in the open and closed positions, respectively.

Figure 8A:
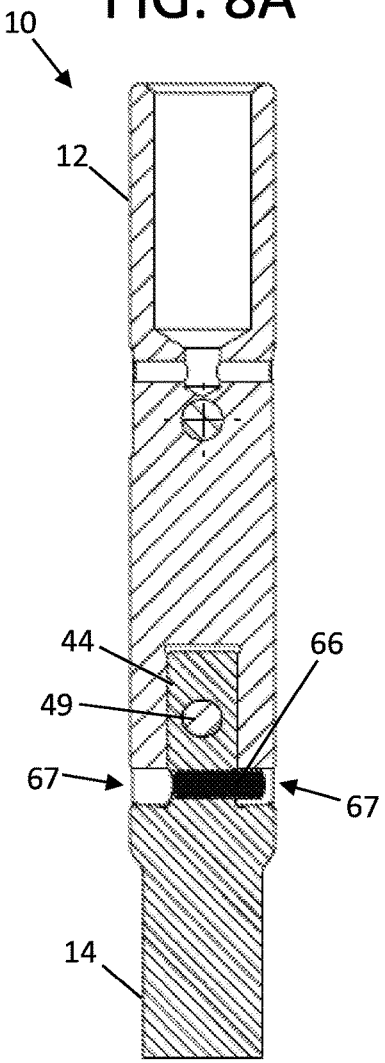
FIGS. 8A and 8B are section and side views of the punch assembly, with an alignment pin radially pressed into the stem of the punch tip insert.
Figure 8B:
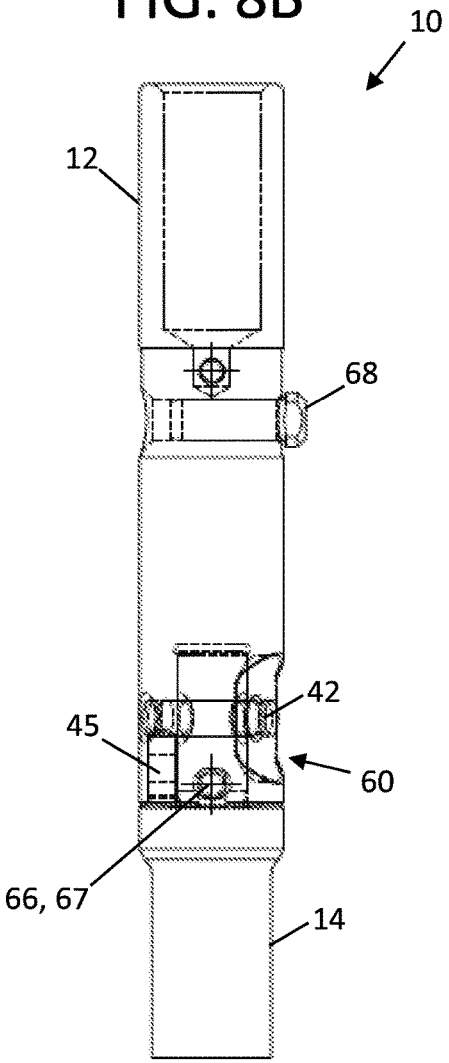

FIG. 8A is a section view of punch assembly 10, illustrating an alternative way to provide an angular connection in which the alignment pin and slot configuration is substantially reversed between punch body 12 and punch tip 14. FIG. 8B is a side view of punch assembly 10, in the same configuration as FIG. 8A.

As shown in FIGS. 8A and 8B, a radially oriented dowel or alignment pin 66 is pressed into stem 44 in punch tip 14, e.g., with a horizontal orientation as shown. Corresponding alignment slots 67 may extend through both sides of punch body 12, or be provided on just one side (e.g., from the bottom of punch body 12). Rather than providing a horizontal alignment slot 67 in either the bottom portion of punch body 12 or the flange portion of punch tip 14, such an alignment slot 67 could also be provided on the top of stem portion 44 (see also FIGS. 11A, 11B, 15C and 15D), with punch body 12 having a radially located dowel or pin 66 to engage within slot 67 to fix the angular orientation of punch tip 14 with respect to punch body 12. Such a horizontally oriented slot 67 could also go all the way across the punch stem 44 so that an alignment pin 66 could connect on both sides of the punch cavity 54 to offer even higher precision alignment (See FIGS. 15A and 15B).

Figure 15A:
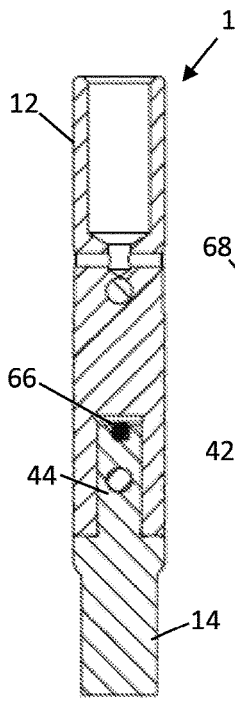
FIGS. 15A and 15B are section views of the punch assembly, with a through-pin for precision angular orientation at the top of the punch tip stem.
Figure 15B:
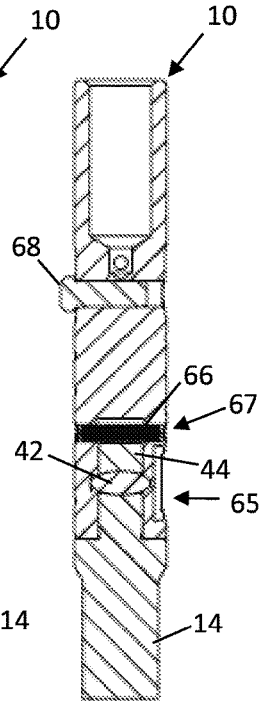
Figure 15C:
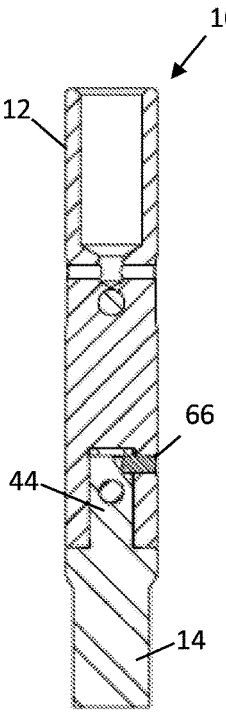
FIGS. 15C and 15D are section and side views of the punch assembly, with a horizontal pin configured for precision alignment with the top of the tip punch tip shank.
Figure 15D:
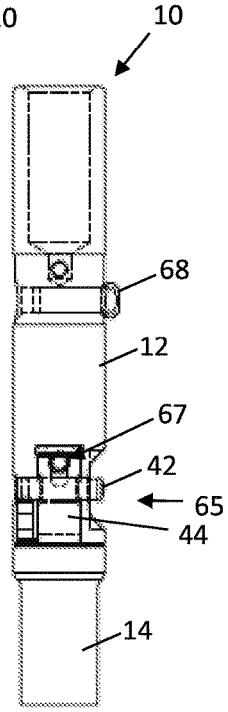
Figure 15E:
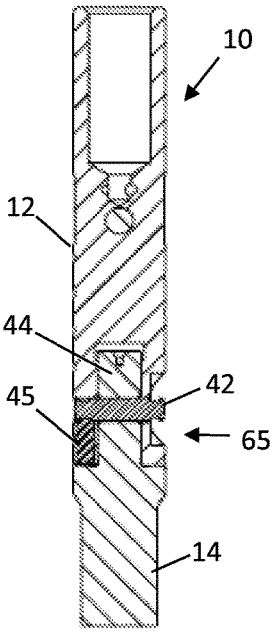
FIG. 15E is a section view of the punch assembly, with the pin coupling configured for precision angular alignment.
Figure 15F:
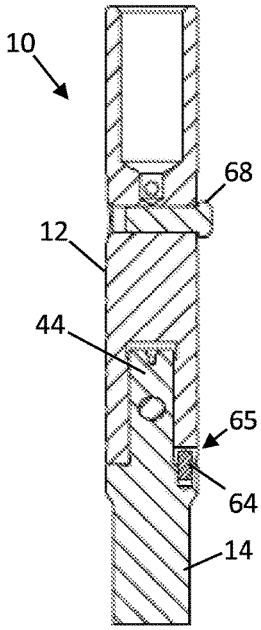
FIGS. 15F and 15G are section and side views of the punch assembly, with a vertical alignment pin in the punch tip flange.
Figure 15G:
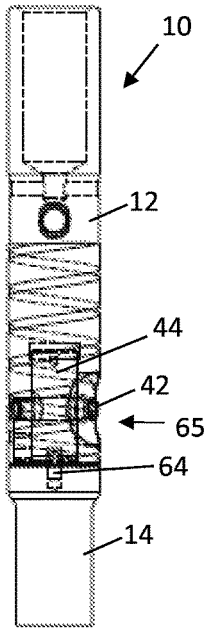

In additional embodiments, rather than providing an axial alignment slot 65 in punch tip 14 and an axially located alignment pin 64 in punch body 12, as described above, the configuration could also be substantially reversed in order to have an axially located pin alignment 64 in punch tip 14 and a precision alignment slot 65 in punch body 12 (see FIGS. 15F and 15G). Rather than providing punch key 68 in the side of punch body 12 and a pin/slot connection to orient the angular position of punch tip 14 with respect to the punching machine or apparatus, a punch key could also be provided directly on punch tip 14. Instead of using an alignment pin 64/66 and slot 65/67 to orient the insert or punch tip 14 with respect to punch body 12, the fit of coupling pin 42 could also be formed with sufficient precision to provide the selected or required precision in angular orientation (see FIG. 15E).

Figure 9A:
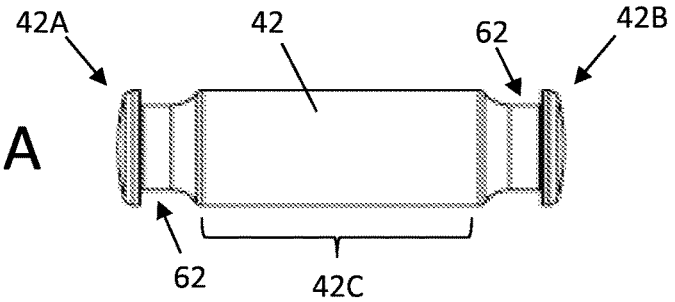
FIGS. 9A, 9B, 9C, 9D and 9E are side views of coupling pins configured for various embodiments of the punch assembly.

FIGS. 9A, 9B, 9C, 9D and 9E are side views of coupling pin 42 for punch assembly 10, in various embodiments. As shown in FIG. 9A, for example, the outside edge of engagement groove 62 is substantially straight, changing the actuation force for the ball of the plunger when moving pin 42 in a particular (e.g., undesired) direction. Thus, engagement feature 62 may be configured to require a substantially greater force to move pin 42 in one direction (e.g., the direction in which it would be removed from the punch body or punch assembly), than in the other (opposite) direction (e.g., between the open and closed positions).

Figure 9E:
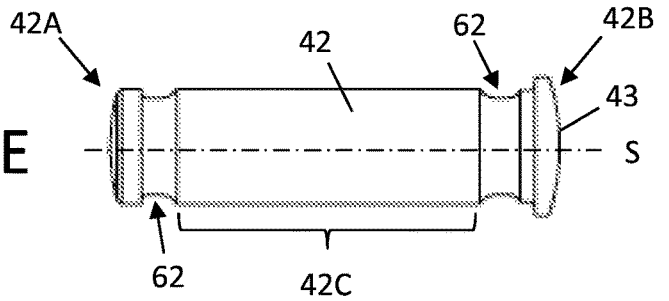
Figure 9D:
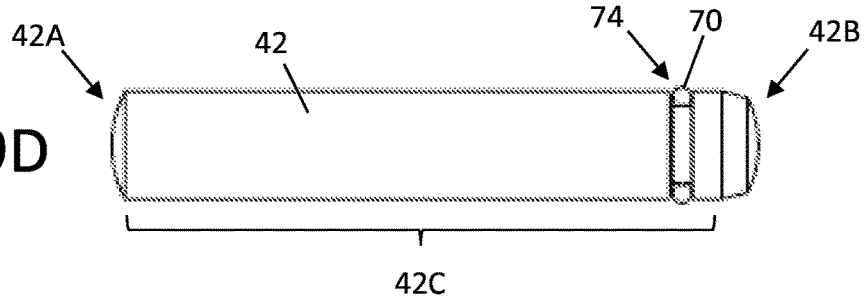
Figure 9C:
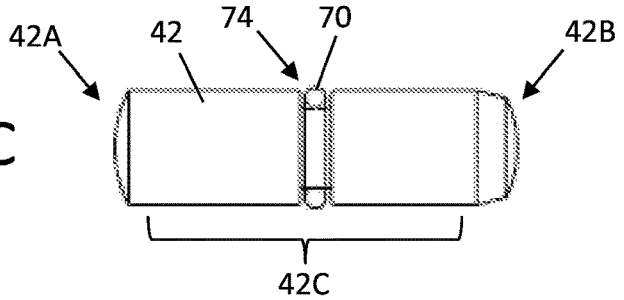
Figure 9B:
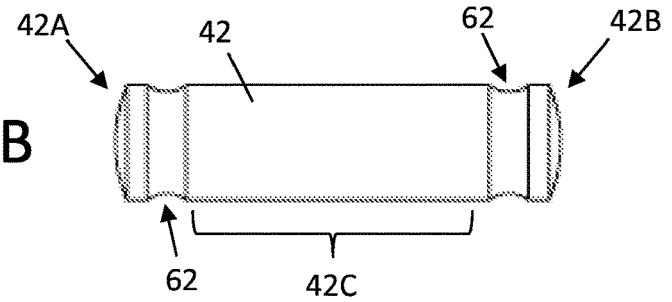

As shown in FIG. 9B, pin 42 is provided with on or more simple curved engagement grooves 62. In one example, grooves 62 are symmetrically configured for receiving the ball plunger (or other bias element), and engaging or disengaging with a substantially equal force when pin 42 is manipulated in either direction. In another example, asymmetric grooves or detents 62 can be provided at first and second ends 42A and 42B of coupling pin 42, so that the force required to remove coupling pin 42 from punch assembly 10 is different from (e.g. substantially greater than) the force required to manipulate coupling pin 42 between the first position (central portion 42C engages punch tip stem 44 with both ends 42A and 42B disposed within the OD of punch body 12), and the second position (central portion 42C disengages punch tip stem 44 with at least part of coupling pin 42 extending outside the OD).

FIG. 9C illustrates an embodiment of pin 42 with a resilient pin retention member 70, for example as engaged in a groove 74 provided in the middle portion 42C of retention pin 42. Alternatively, groove 74 may be provided in various configurations and locations, for example as described for retention groove 62. Suitable resilient retention members 70 include, but are not limited to, round elastic membranes such as rubber or polymer O-rings, and other resilient members configured to offer resistance to the motion of retention pin 42, e.g., when manipulated between the open and closed positions.

FIG. 9D is an example of a similar but more elongate pin 42 configured for a different punch style (see, e.g., FIG. 7B), with the O-ring or other resilient retention member 70 positioned in groove 74 proximate first end 42A, rather than in the center region of middle portion 42C. Alternatively, retention member 70 may be positioned in a groove 74 proximate second end 42B, or anywhere else along middle body portion 42C.

FIG. 9E shows an example of pin 42 with an end cap or head 43 on first end 42A. End cap 43 has a diameter or width (e.g., transverse to pin axis A) than that of middle body portion 42C, while second end 42B has a diameter similar to or smaller than that of middle body portion 42C. Thus, the end cap (or first end 42A) can be configured to provide a stop feature when pin 42 is inserted into a hole or cavity dimensioned to accommodate the width or diameter of first end 42A and body portion 42C, but smaller than the width or diameter of second end 42B. Since second end 42B is larger than the pin slot, pin 42 stops when end cap 43 reaches the slot, and pin 42 is fully inserted; e.g., as shown in FIG. 10A.

FIG. 10A is a section view of punch assembly 10, showing an alternate configuration for coupling pin 42. FIG. 10B is a supplemental side view of coupling pin 42 as configured in FIG. 10A. In this configuration, pin 42 has head or cap 43 on one side, configured to provide a positive stop so that pin 42 cannot be pushed too far into punch body 12 from that side.

For example, head 43 may have a greater outer radius R than the longitudinal body (center portion 42C) of pin 42 (and the corresponding longitudinal cavity extending through punch body 12 and punch tip stem 44). If installed correctly, this configuration prevents the operator from pushing pin 42 too far into punch body 12, by seating head 43 of pin 42 in the correct stop position inside a fitted pocket 61 recessed within the outer diameter of punch body 12, as shown in Detail D (opposite relief feature 60, as configured for manual access to the opposite end of pin 42). A groove 62 can also be provided to retain pin 42 in position within the fitted pocket, e.g., by engagement with ball plunger 45 or other biasing component.

FIG. 10C is a side view of a punch assembly 10 with a spiral groove 86 provided on punch body 12. As shown in FIG. 10C, one or more spiral grooves or other lubrication features 86 are formed on the outer diameter (OD) of punch body 12, providing more uniform fluid flow for reduced friction punch-to-guide operation.

One or more grooves 86 may also be formed around punch tip 14, in an optional geometry. Punch body 12 may also be provided with additional features such as a relief cavity 60 and an alignment key 68, as described above.

Alternate Embodiments

In any of the embodiments and examples herein, the sliding pin can be resiliently urged into its open or unlocked and closed or locked positions with one or more rubber rings fitting into radial grooves.

The end geometries of the punch tip and punch body can also be reversed, such that the punch body has a protruding axial tang or stem and the punch tip has an axial cavity to receive the punch body tang.

Rather than angular keying being achieved via a key in the side of the punch body, in combination with a pin and slot connection to the punch tip, a punch key which keys to the punch guide body or bushing could be put directly into the punch tip.

Rather than providing a key alignment slot in the punch tip and an axially located pin in the punch body, the configuration could be reversed to have an axially located pin in the punch tip and a precision angular alignment slot in the punch body.

Instead of using an alignment pin and slot to orient the punch tip with respect to the punch body, the fit of the coupling pin could provide sufficiently precise angular orientation without additional keying means.

Examples

The following examples are provided to illustrate the potential scope of various embodiments of the invention. Each of these examples may be provided in any combination with any of the other examples and embodiments described herein.

1. A removable lower portion punch tip can be provided for punch press tooling, held into a punch body upper portion by a manually operable slide-in or sliding pin, which is pushed or pulled into either an open position for installation or removal of a punch tip, or a locked position for secured operation in a punch press. The punch body has a lower portion with an axial cavity, and the punch tip has an upper portion with an axial stem or protrusion with fits into the cavity in the punch body.

The punch tip stem has a radial cavity with geometry which corresponds to the geometry of the pin, so that in one radial position the pin is not engaged with the radial cavity of the punch tip, and the punch tip can be removed from the assembly. In another radial position the pin is fully engaged with the radial cavity of the punch tip, the punch tip cannot be removed or inserted from the punch body but is secured for operation in a punch press, where the assembly of the punch body and punch tip can slidably operate in a punch guide or bushing as a hybrid replacement punch.

2. The punch tip can have an upper portion which is an axial protrusion configured to engage into a pocket in the lower portion of the punch body for axial affixing thereto.

3. The pin can alternately be held resiliently in an open or locked position with a ball plunger or rubber rings and grooves, preventing unwanted release of the punch tip during handling outside of the punching machine, punch guide, or bushing.

4. The task or function of the ball plunger could be achieved with a piece of urethane or other similar component, which presents sufficient resilient properties for urging and retaining the pin into alternate open or unlocked and engaged or locked positions.

5. The pin can have sufficient length to prevent disengagement from the punch tip when the assembly is installed in a punch guide or bushing, assuring the pin stays securely in the locked position while in operation within the punch guide or bushing.

6. The pin can be alternately held in an open or locked position with frictional means, preventing unwanted movement in a radial direction on the punch body.

7. The punch body can have a lower stem, tang or shank and the punch tip can have the cavity to receive the stem, tang or shank of the punch body.

8. The pin can have a head on one end and the punch body or driver r can have a fitted pocket for the head to prevent pushing the pin through the driver in the wrong direction.

Elastic Bumper Member

Figure 11A:
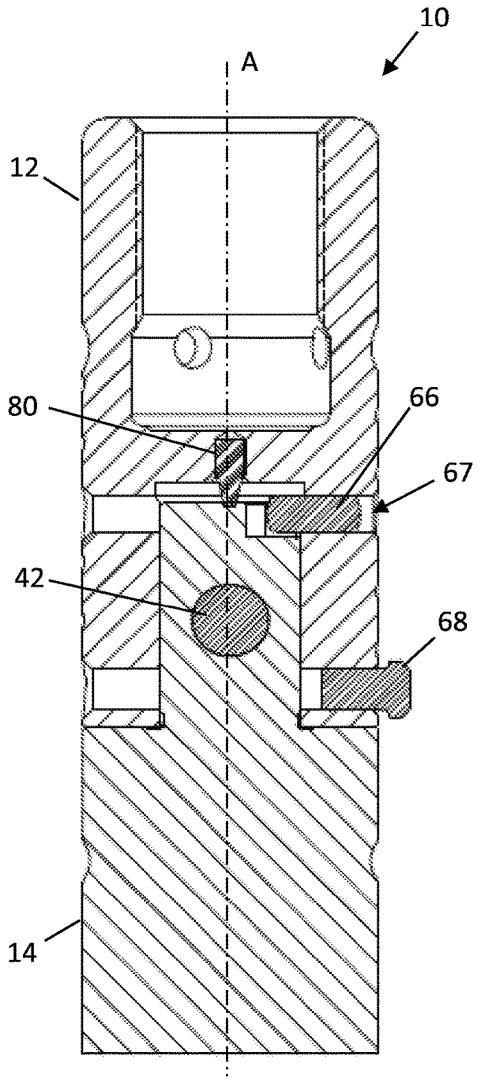
FIGS. 11A and 11B are section and side views of the punch apparatus with an elastic bumper element and a radial alignment pin engaged at the top of the punch tip stem.
Figure 11B:
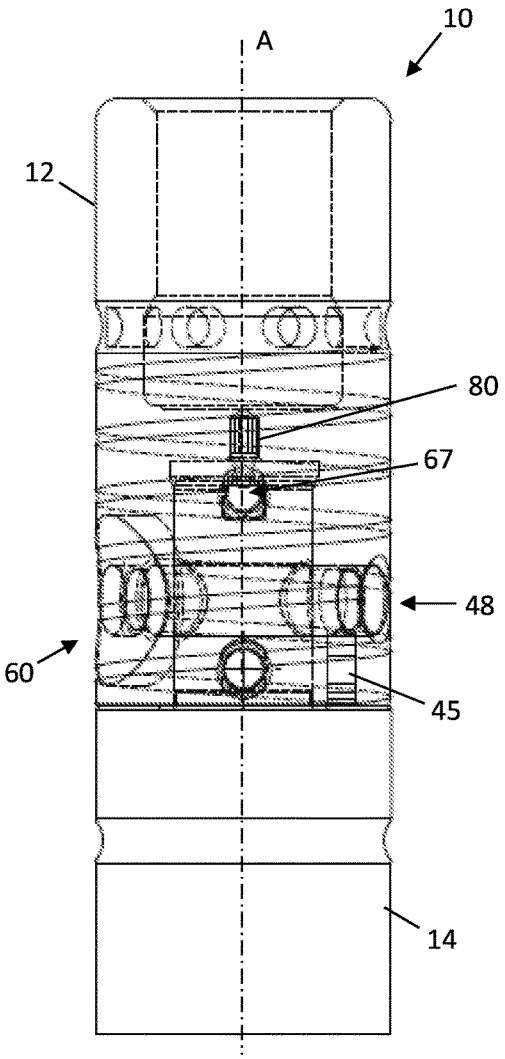

FIGS. 11A and 11B are section and side views of punch assembly 10, respectively, with an elastic bumper member 80 configured to remove "jiggle" of the punch insert (or punch tip) 14 with respect to the punch body (or punch driver) 12. In this particular example, a sliding pin coupling mechanism 42 and resilient ball plunger 45 are used, with a laterally-oriented pin 66 and slot 67 to provide precision angular alignment between punch tip 14 and punch body 12 with anti-rotation key 68. Alternatively, various bumper members 80, 82 and 84 (see FIGS. 12A and 12B) can be used with any of the punch assembly designs described herein.

Bumper member 80 can be formed of an elastic material such as a plastic or rubberized polymer, or provided as a resilient (e.g., spring) bias element, which is positioned to dampen or reduce relative motion between punch body/driver 12 and removable punch tip or insert 14. Bumper member 80 is configured to provide sufficient resilient bias to reduce "jiggle," shaking, wiggling, and other motion of punch insert 14 with respect to punch driver 12, e.g., due to vibration or during assembly of the punch assembly or apparatus 10. At the same time, bumper member 80 can also be substantially isolated from the punch and stripping load paths, as described above.

As shown in FIGS. 11A and 11B, for example, elastic bumper member 80 is positioned along punch axis A of punch assembly 10, and disposed between punch driver 12 and the upper surface of punch insert 14 (that is, within the axial cavity where the stem or tang of punch tip insert 14 is received in punch driver 12). In this example, one end of bumper 80 can be formed as an elongated elastic member inserted into an axial hole in punch driver 12, extending upward from the bottom cavity. The other end of bumper 80 contacts the upper surface of punch insert 14, in a compressive or resilient coupling relationship to reduce relative motion.

Figure 12A:
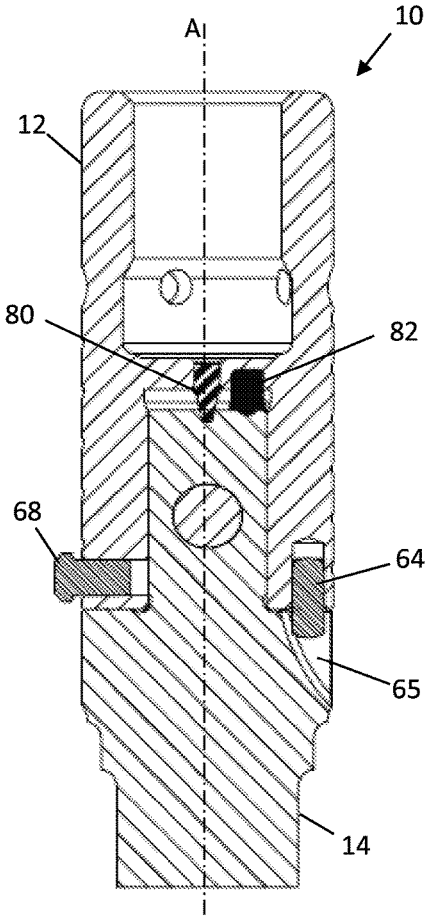
FIGS. 12A and 12B are section views of the punch apparatus, showing various bumper element configurations.
Figure 12B:
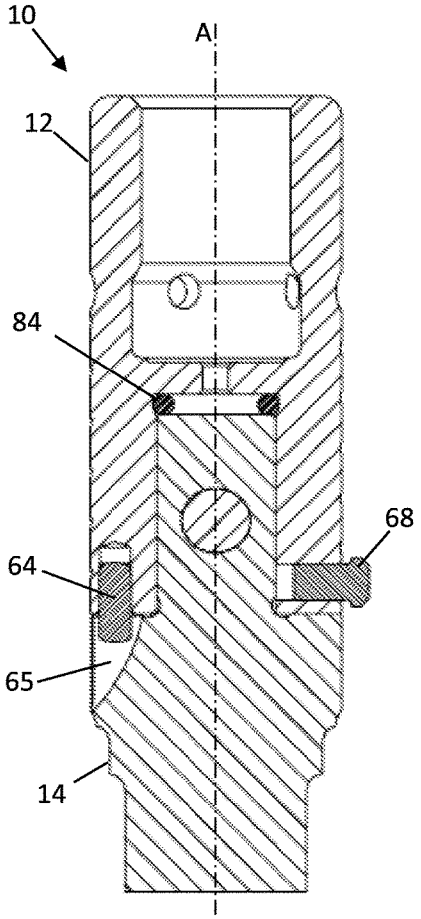

FIGS. 12A and 12B are section views of punch assembly 10, with various elastic bumper members 80, 82 and 84. In these examples, an axial precision alignment pin 64 and curve precision slot 65 may be used, as configured for manual insertion of alignment pin 64 into an axial cavity within the lower portion of punch body 12.

Bumpers 80, 82 and 84 may be formed as an elongate, axially projecting member, a ball plunger, and an elastic ring (or resilient disk), respectively, each positioned between the upper surface of punch insert 14, where stem 44 is received within the axial cavity in the bottom of the punch driver (or punch body) 12. For example, bumper member 84 can be provided in the form of an O-ring positioned about axis A of punch assembly 10, as shown in FIG. 12B, in a compressive coupling or biasing relationship between punch driver 12 and the upper surface of punch tip or insert 14. Alternatively, an axial bumper member 80 and/or ball plunger 82 can be used, as shown in FIG. 12A, or bumper member 84 can be provided in the form of a resilient ring or disk disposed between punch body 12 and the top surface of punch tip 14 (FIG. 12B). In any of these examples, one or both of punch body 12 and punch tip insert 14 can be provided with grooves, chamfers or other surface features configured to receive one or more of bumper members 80, 82 and 84, and to help retain the bumper members in a suitable position between punch body 12 and punch tip insert 14.

Lubrication

Figure 13A:
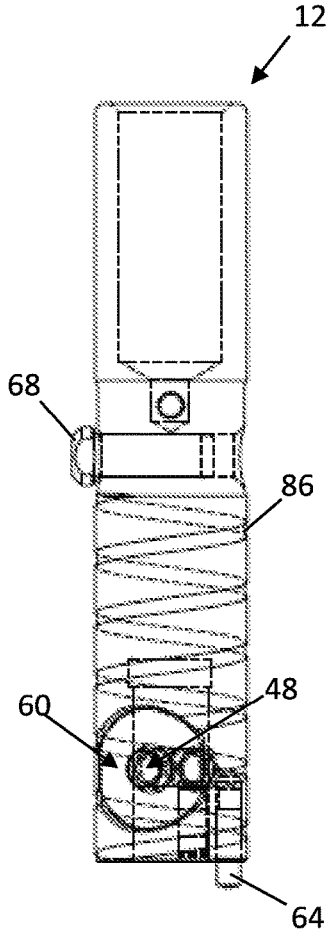
FIGS. 13A and 13B are side views of representative punch tip bodies having different outside diameters, illustrating representative lubrication grooves and alignment features.
Figure 13B:
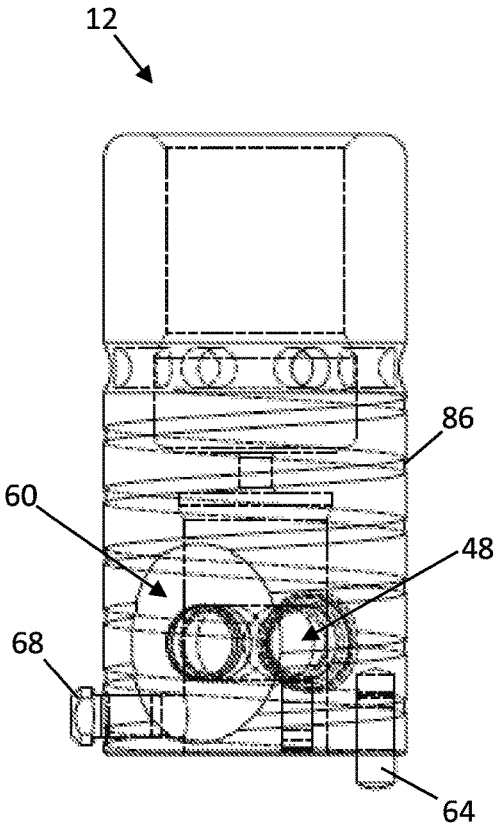

FIGS. 13A and 13B are side views of punch body 12 with spiral grooves 86 provided for lubrication on the outer diameter (OD). In this particular example, a vertical alignment pin 64 is utilized, e.g., extending from the bottom of punch body 12 and configured for insertion into a corresponding precision alignment slot or bore in the punch tip.

Punch body 12 of FIG. 13B is scaled with respect to punch body 12 of FIG. 13A, for example as configured for relatively smaller and relatively larger punch stations, respectively. In addition, alignment features such as pins 64 may be absent, or take another form, as described below.

Figure 14A:
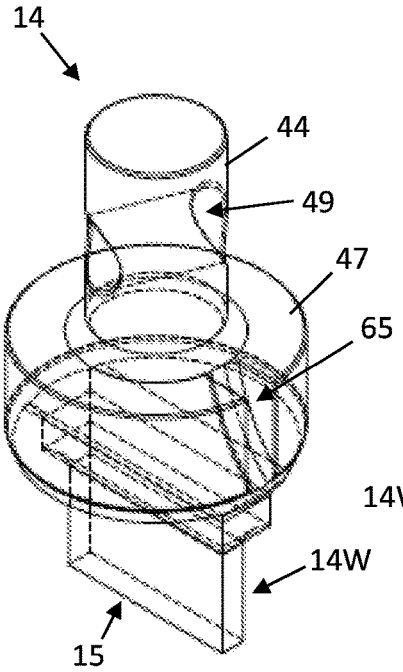
FIGS. 14A, 14B, 14C and 14D are isometric views of representative punch tips for the punch assembly, for different punch stations sizes.

FIGS. 14A, 14B, 14C and 14D are isometric views of representative punch tips 14, e.g., for use with punch body 12 of FIG. 13A or FIG. 13B. In the example of FIG. 14A, punch tip 14 is provided with a substantially right rectangular prism working end 14W, with a corresponding rectangular punch tip 15. A curved or angled precision alignment slot 65 is provided in flange portion 47, for mating with a corresponding pin in the punch body.

Figure 14B:
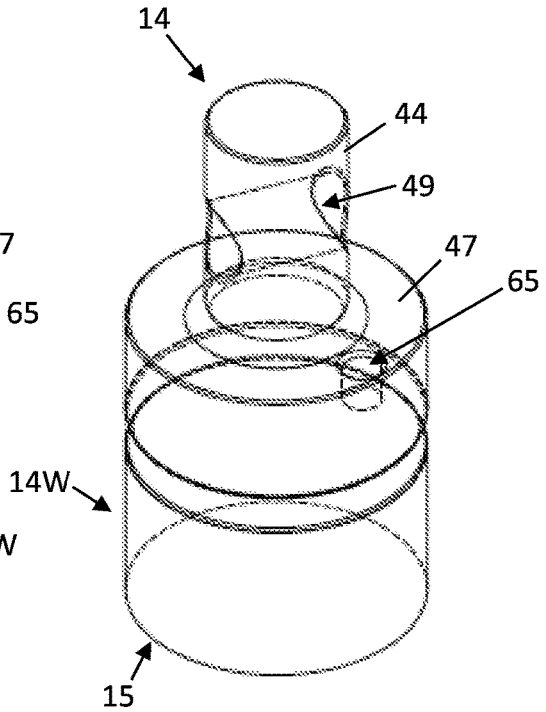
Figure 14C:
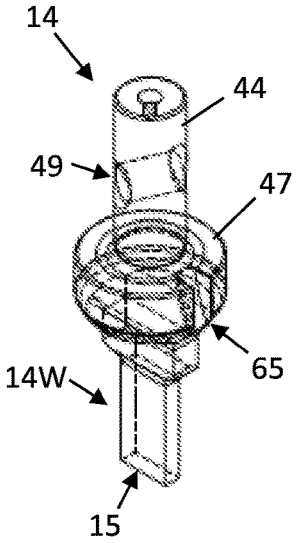
Figure 14D:
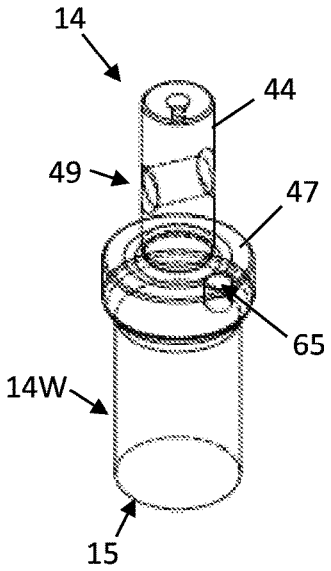

In the alternate example of FIG. 14B, working end 14W of punch tip 14 has a substantially cylindrical configuration, ending in a circular punch point 15. Alignment is provided with a circular slot or bore 65 formed in the top surface of flange 47, radially inward of the outer flange diameter. FIGS. 14C and 14D are scaled versions of punch tips 14 as shown in FIGS. 14A and 14B, as configured for relatively smaller and larger punch stations, respectively.

FIGS. 15A and 15B are section views of punch assembly 10, with a radial or horizontally-oriented through-pin 67 configured for precision angular orientation of punch tip 14 with respect to punch body 12. As shown in FIG. 15A, through pin 67 extends through a corresponding slot or hole 67 at the top of the punch tip (or insert) stem 44, for increased precision in angular orientation. As shown in FIG. 15B, slot 67 also extends through the outer diameter on both sides of punch body 12, providing for insertion of through-pin 67 from either direction.

FIGS. 15C and 15D are section and side views of punch assembly 10, with a radial or horizontal pin 66 configured for precision alignment with the top of the punch tip shank or stem 44. As compared to FIGS. 15A and 15B, horizontal pin 66 of FIGS. 15C and 15D extends through only one side of punch body 12, and only partially into punch tip stem 44.

FIG. 15E is a section view of the punch assembly, with coupling pin 42 configured for precision angular alignment of punch tip 14 with respect to punch body 12. In this example, precision alignment is achieved via the tolerance of coupling pin 42 with respect to the corresponding hole or bore formed through the punch tip stem 44 and the adjacent OD of punch body 12. A ball plunger or similar resilient component 45 can be provided to retain pin 42 in the engaged position, with recess 65 configured to access the exposed end for manual insertion and removal of coupling pin 42.

FIGS. 15F and 15G are section and side views of punch assembly 10, with a vertical alignment pin 64 in the punch tip flange. In this example, Pin 64 is provided in the flange component of punch tip 14, and configured for insertion into a precision alignment slot 65 in punch body 12.

Figure 16A:
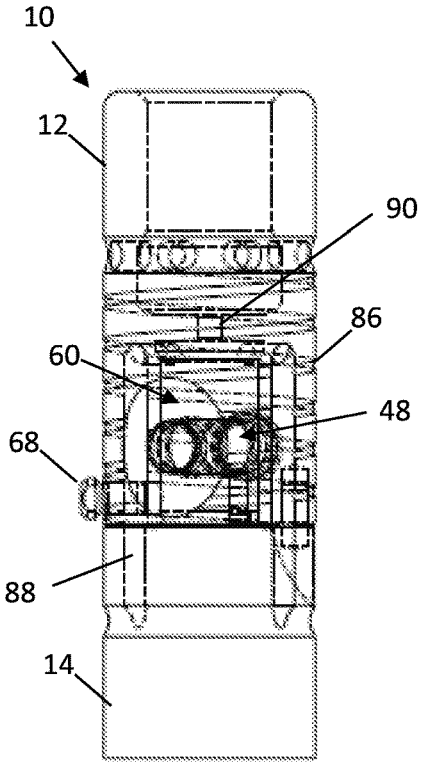
FIGS. 16A and 16B are side views of the punch assembly, illustrating additional lubrication features.
Figure 16B:
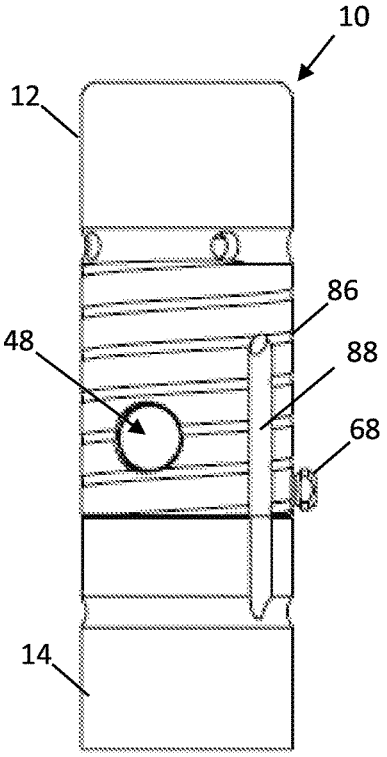
Figure 16C:
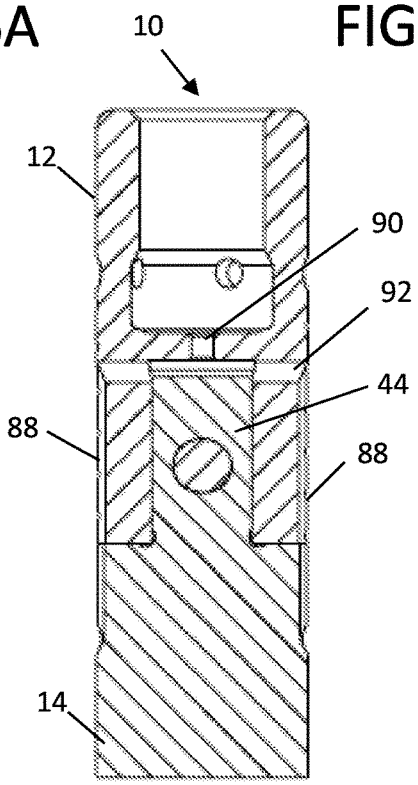
FIG. 16C is a section view of the punch assembly in FIGS. 16A and 16B, showing internal lubrication features.

FIGS. 16A and 16B are side views of punch body 12, with a combination of spiral grooves 86 and vertical grooves 88 provided for lubrication on the outer diameter (OD). FIG. 16C is a section view of punch body 12, showing internal lubrication features including an axial (vertical) lubrication channel 90 along the central axis of punch body 12, and radial (horizontal) channels or ports 92 oriented transverse to the central axis.

As shown in FIGS. 16A-16C, spiral lubrication grooves 86 may be formed on the outer diameter (OD) of punch body 12, providing more uniform fluid flow for reduced friction punch-to-guide operation. One or more longitudinal or vertical slots 88 can also be formed in the outer diameter of one or both of punch body 12 and punch tip 14, for air/oil flow during punching and stripping operations.

Alternatively, one or more spiral grooves 86 may also be formed around the punch tip or insert 14, in an optional geometry. In additional embodiments, one or more horizontal or radial lubrication channels or ports 92 may be provided for internal lubricant flow, e.g., connecting internal (axial) channel 90 to the external (OD) vertical grooves 88, and/or spiral grooves 86.

Figure 17C:
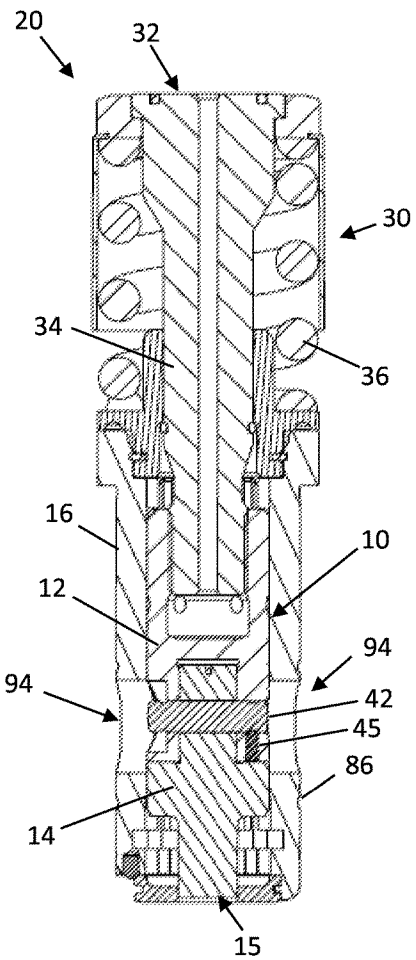
FIG. 17C is section view of the punch apparatus in FIGS. 17A and 17B, showing the access windows on either side of the coupling pin.
Figure 17B:
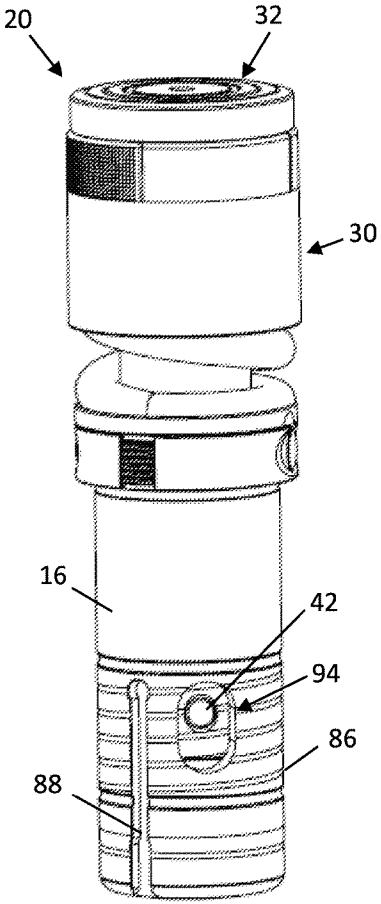
FIGS. 17A and 17B are side and isometric views of a punch apparatus with access windows in the punch guide for operating the pin coupling between the punch body and tip.
Figure 17A:
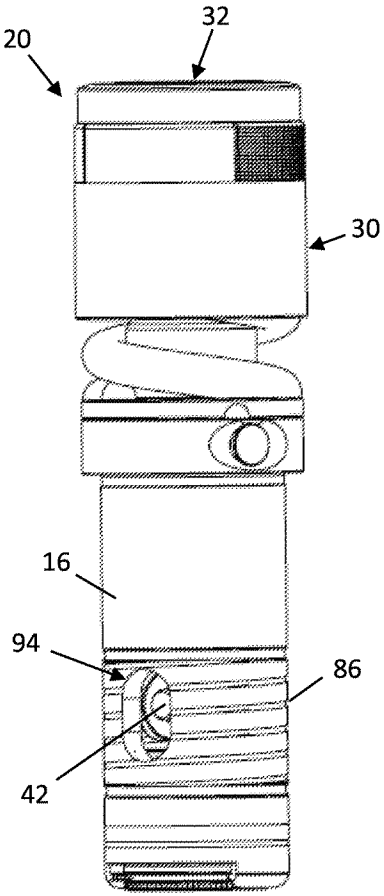

FIGS. 17A and 17B are side and isometric views of punch apparatus 20 with one or more access openings or windows 94 in the bushing or punch guide 16, configured for accessing coupling pin 42. FIG. 17C is section view of the punch apparatus of FIGS. 17A and 17B.

As shown in FIGS. 17A-17C, punch apparatus 20 includes punch canister 30 with punch assembly 10 inserted into punch guide 16. Punch assembly 10 includes punch body 12 and punch tip 14, which is attached to punch body 12 via coupling pin 42. When punch assembly 10 is inserted into a bushing or punch guide 16, coupling pin 42 is exposed at one or both ends via windows 94. Access windows 94 provide for manipulation of coupling pin 42 between engaged and disengaged positions, in order to attach and remove punch tip 14 with punch body 12 retained in punch guide 16.

The access window configuration FIGS. 17A-17C is applicable to advanced punch type systems designs, including, but not limited to, larger station sizes where it is advantageous to remove and replace punch tip insert section 14 while punch body is still inside the bushing or punch guide 16. Access window 94 can also be slotted or extended in the vertical direction, in order to provide access to coupling pin mechanism 42 even when punch head/driver 14 has been adjusted downwards, e.g., after sharpening punch point 15 on punch tip 14.

Figure 18A:
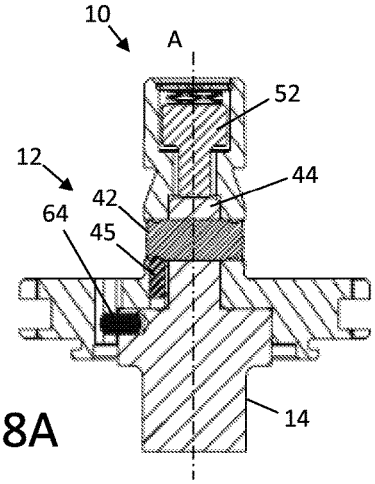
FIGS. 18A and 18B are section and isometric views, respectively, of a punch assembly with a punch body and coupling pin suitable for use in a rail-type press apparatus.
Figure 18B:
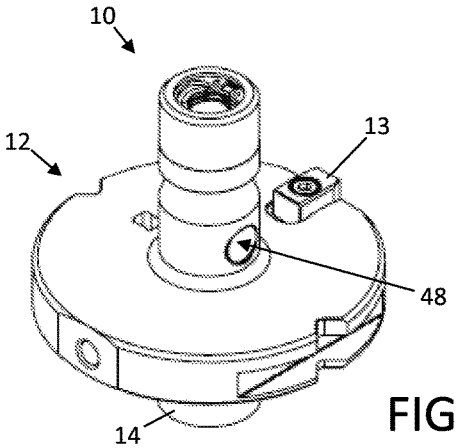

FIGS. 18A and 18B are section and isometric views, respectively, of punch assembly 10 with punch body 12 suitable for use in a rail-type or single-tool punch press apparatus. Coupling pin 42 is shown in the engaged position, with punch tip (or insert) 14 disposed within the axial cavity in punch body 12, and spring ejector 52 compressed against the top of punch tip stem 44. In these embodiments, punch body 12 can be configured for single-tool or rail-type mounting, utilizing punch key 13 for alignment as described above with respect to FIG. 2.

Figure 18C:
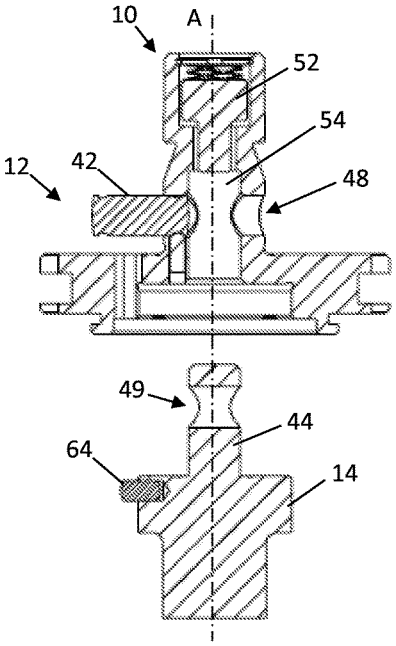
FIGS. 18C and 18D are section and isometric views of the rail-mount type punch body with the punch tip disengaged.
Figure 18D:
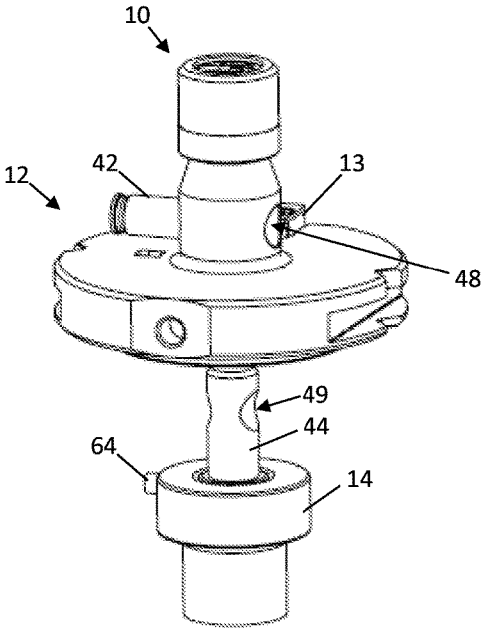

FIGS. 18C and 18D are section and isometric views, respectively, of a rail-mount punch assembly 10 with punch tip 14 decoupled from punch body 12. Coupling pin 42 is shown in the disengaged position, with punch tip 14 removed from axial cavity 54 in punch body 12 along punch axis A.

Additional Examples and Embodiments

According to the various examples and embodiments herein, a punch assembly may comprise: a punch body configured for a punching operation in a punch press, the punch body having an axial cavity defined along an axis; a punch tip having a first end configured for the punching operation and a second end comprising a punch tip stem configured for selective engagement within the axial cavity in the punch body; and a coupling pin disposed transverse to the axis of the punch body, the coupling pin comprising a first end, a second end, and a middle portion between the first and second ends; wherein the first end of the coupling pin is configured for manipulation of the coupling pin transverse to the axis of the punch body to selectively engage and disengage the punch tip stem.

The punch assembly may comprise first and second openings in the punch body configured for selective engagement and disengagement with the first and second ends of the coupling pin, and further comprising a lateral cavity in the punch tip stem configured for selective engagement and disengagement with the middle portion of the coupling pin. The coupling pin may have a first position with the first and second ends engaged with the punch body and the middle portion engaged within the punch tip stem, and a second position with the middle portion disengaged from the punch tip stem.

The punch assembly may comprise a bias member configured to selectively bias the coupling pin in the first and second positions, wherein the bias member comprises a ball plunger, resilient O-ring, or frictional member. The punch assembly may further comprise at least one groove or detent on the coupling pin configured to selectively engage and disengage the bias member.

The punch assembly may comprise a cap or stop configured to seat the second end of the coupling pin against the punch body, wherein manipulation of the coupling pin to disengage the punch tip stem is allowed in a first direction transverse to the axis of the punch body and prevented in a second direction transverse to the axis of the punch body. The coupling pin may have sufficient length to prevent disengagement from the punch tip stem when the punch body is disposed within a punch guide or bushing of the punch press, the coupling pin being constrained substantially within an outer diameter of the punch body by the punch guide or bushing.

The punch assembly may comprise: a punch guide or bushing disposed about the punch body; and at least one access window in the bushing or punch guide, the access window configured for manipulation of the coupling pin to selectively engage and disengage the middle portion with a lateral channel in the punch tip stem, while the punch body is disposed within the bushing or punch guide. At least two of the access windows may be provided for access to the first and second ends of the coupling pin, respectively. Each access window may be configured to accommodate axial adjustment of the punch assembly within the bushing or punch guide, while maintaining access to the coupling pin for manipulation thereof.

The punch assembly may comprise an alignment pin disposed in one of the punch tip and the punch body, the alignment pin configured for angular alignment of the punch tip about the axis of the punch body by engagement with a complementary alignment slot disposed in another of the punch tip and punch body. The alignment pin may be configured for axial engagement with the alignment slot when the punch tip stem is disposed within the axial cavity of the punch body. The alignment pin may be configured for lateral or radial engagement within the alignment slot, transverse to the axis of the punch body. Alternatively, the coupling pin may be configured for angular orientation of the punch tip with respect to the punch body by lateral engagement of the middle portion of the coupling pin within a precision receiving slot defined in the punch tip stem, absent other pin and slot alignment features configured for relative angular alignment of the punch tip with respect to the punch body.

The punch assembly may comprise a flange on the punch tip, the flange configured to transfer a compressive load from a bottom surface of the punch body to a working end of the punch tip during the punching operation in the punch press, wherein the coupling pin is substantially isolated from the compressive load. The punch assembly may further comprise an elastic member disposed in biasing relationship between the punch body and the punch tip when the punch tip stem is engaged in the axial cavity. The elastic member may comprise one or more of an elastic bumper member, an O-ring, a spring and a ball plunger configured to reduce relative motion of the punch tip when engaged with the punch body. The one or more grooves or detents may define an asymmetric geometry at the first and second ends of the coupling pin, the asymmetric geometry adapted for increasing a force required to remove the coupling pin, as compared to manipulating the coupling pin between the first and second positions.

According to additional examples and embodiments herein, a punch system may comprise: a punch body having an axis; a punch tip having a first end configured for a punching operation and a second end configured for selective engagement and disengagement with the punch body along the axis; and a coupling pin disposed transverse to the axis, the coupling pin comprising a first end, a second end, and a middle portion therebetween, the first and second ends configured for manipulation of the coupling pin transverse to the axis of the punch body to selectively engage and disengage the middle portion with the punch body and the punch tip; wherein the coupling pin has a first position in which the punch tip and punch body are engaged with the first and second ends of the coupling pin disposed within an outer diameter thereof, and a second position in which the punch tip and punch body are disengaged with at least one of the first and second ends of the coupling pin disposed outside the outer diameter.

The punch system may comprise an axial cavity in the punch body and a stem extending from the second end of the punch tip, the stem having a lateral cavity configured for selective engagement and disengagement with the middle portion of the coupling pin when disposed within the axial cavity of the punch body. Alternatively, the punch system may comprise an axial cavity in the second end of the punch tip and a stem extending from the punch body, the stem having a lateral cavity configured for selective engagement and disengagement with the middle portion of the coupling pin when disposed within the axial cavity of the punch tip.

The punch system may comprise a bias member configured to selectively engage and disengage one or more grooves or detents in the coupling pin, in the first and second positions thereof. The punch system may further comprise an alignment slot disposed in one of the punch body and the punch tip and a complementary alignment pin disposed in another of the punch body and the punch tip, the alignment slot and pin configured for axial or radial engagement to maintain precision orientation of the punch tip with respect to the punch body. The alignment pin may be configured for radial engagement with a lateral alignment slot extending through the punch tip and the punch body, or for radial engagement with a top end of a stem extending from the second end of the punch tip into an axial cavity in the punch body.

The punch system may comprise a punch guide disposed about the punch body in a turret press apparatus, the punch guide having at least one access window configured for manipulation of the coupling pin between the first and second positions when the punch body is disposed within the punch guide. The punch system may also comprise a bushing disposed about the punch body in a rail-type press apparatus. An ejector may be configured to urge the punch tip from the punch body along the axis when the coupling pin is manipulated from the first position to the second position.

A pocket may be disposed in the punch body or punch tip proximate the first end of the coupling pin, wherein the pocket defines a straight or curved recess adapted for manual access to push or pull the first end of the coupling pin transverse to the axis of the punch body. Such straight or curved recesses may be defined in opposing positions on an outer diameter of the punch body or punch tip, the recesses adapted for manual access to push or pull each of the first and second ends of the coupling pin transverse to the axis of the punch body.

A method for any of the above punch assemblies and systems may comprise: engaging a punch tip with a punch body along an axis thereof, the punch tip configured for a punching operation in combination with the punch body; manipulating a coupling pin transverse to the axis into a first position in which the coupling pin engages a stem on the punch tip or punch body, wherein the coupling pin is disposed within an outer diameter thereof, in the first position; manipulating the coupling pin transverse to the axis into a second position in which the coupling pin is disengaged from the stem, wherein at least a portion of the coupling pin is disposed outside the outer diameter, in the second position; and disengaging the punch tip from the punch body along the axis.

Manipulating the coupling pin into the second position may comprise pushing the first end of the coupling pin into a curved or straight recess defined in an outer diameter of the punch tip or punch body; grabbing a second end of the coupling pin extending outside the outer diameter opposite the recess; and pulling the second end of the coupling pin transverse to the axis of the punch body. The method may also comprise installing the punch body in a punch guide or bushing of a punch press apparatus, and manipulating the coupling pin between the first and second positions via at least one access window provided in the punch guide or bushing.

While this invention has been described with reference to exemplary embodiments, it will be understood by those skilled in the art that various changes can be made and equivalents may be substituted without departing from the spirit and scope thereof. Modifications may also be made to adapt the teachings of the invention to particular problems, technologies, materials, applications and materials, without departing from the essential scope thereof. Thus, the invention is not limited to the particular examples that are disclosed herein, but encompasses all embodiments falling within the scope of the appended claims.

The invention claimed is:

1. A method for operating a punch assembly comprising a punch body configured for a punching operation in a punch press, the method comprising:

engaging a removable, unitary punch tip with the punch body having an axial cavity defined along an axis thereof, the punch tip extending from a first end portion configured for the punching operation in combination with the punch body to a second end portion comprising a punch tip stem configured for selective engagement within the axial cavity in the punch body;

manipulating a coupling pin disposed transverse to the axis of the punch body into a first position in which the coupling pin engages a stem on the punch tip or punch body, the coupling pin comprising a first end, a second end, and a middle portion between the first and second ends, wherein first and second openings in the punch body are configured for selective engagement and disengagement with the first and second ends of the coupling pin, wherein a lateral cavity in the punch tip stem is configured for selective engagement and disengagement with the middle portion of the coupling pin, and wherein the coupling pin is disposed within an outer diameter of the punch body, in the first position;

manipulating the coupling pin transverse to the axis into a second position in which the coupling pin is disengaged from the stem, wherein the first end of the coupling pin is configured for manipulation of the coupling pin transverse to the axis of the punch body to selectively engage and disengage the punch tip stem and at least a portion of the coupling pin is disposed outside the outer diameter, in the second position; and disengaging the punch tip from the punch body along the axis.

2. The method of claim 1, wherein manipulating the coupling pin into the second position comprises:

pushing the first end of the coupling pin into a curved or straight recess defined in an outer diameter of the punch tip or punch body;

grabbing a second end of the coupling pin extending outside the outer diameter opposite the recess; and pulling the second end of the coupling pin transverse to the axis of the punch body.

3. The method of claim 1, further comprising:

installing the punch body in a punch guide or bushing of a punch press apparatus, and manipulating the coupling pin between the first and second positions via at least one access window provided in the punch guide or bushing.

4. The method of claim 1, wherein a diameter of the punch tip stem is smaller than an outside diameter of the first end of the punch tip.

5. A punch assembly comprising:

a punch body configured for a punching operation in a punch press, the punch body having an axial cavity defined along an axis;

a removable, unitary punch tip extending from a first end portion configured for the punching operation to a second end portion comprising a punch tip stem configured for selective engagement within the axial cavity in the punch body;

a coupling pin disposed transverse to the axis of the punch body, the coupling pin comprising a first end, a second end, and a middle portion between the first and second ends;

first and second openings in the punch body configured for selective engagement and disengagement with the first and second ends of the coupling pin; and a lateral cavity in the punch tip stem configured for selective engagement and disengagement with the middle portion of the coupling pin, wherein the first end of the coupling pin is configured for manipulation of the coupling pin transverse to the axis of the punch body to selectively engage and disengage the punch tip stem.

6. The punch assembly of claim 5, wherein the coupling pin has a first position with the first and second ends engaged with the punch body and the middle portion engaged within the punch tip stem, and a second position with the middle portion disengaged from the punch tip stem.

7. The punch assembly of claim 6, further comprising a bias member configured to selectively bias the coupling pin in the first and second positions, wherein the bias member comprises a ball plunger, resilient O-ring, or frictional member configured to selectively engage and disengage at least one groove or detent on the coupling pin.

8. The punch assembly of claim 5, further comprising a cap or stop configured to seat the second end of the coupling pin against the punch body, wherein manipulation of the coupling pin to disengage the punch tip stem is allowed in a first direction transverse to the axis of the punch body and prevented in a second direction transverse to the axis of the punch body.

9. The punch assembly of claim 5, wherein the coupling pin has sufficient length to prevent disengagement from the punch tip stem when the punch body is disposed within a punch guide or bushing of the punch press, the coupling pin being constrained within an outer diameter of the punch body by the punch guide or bushing.

10. The punch assembly of claim 5, further comprising:

a punch guide or bushing disposed about the punch body, and at least one access window in the bushing or punch guide, the access window configured for manipulation of the coupling pin to selectively engage and disengage the middle portion with a lateral channel in the punch tip stem, while the punch body is disposed within the bushing or punch guide.

11. The punch assembly of claim 10, wherein such access windows are provided for access to each of the first and second ends of the coupling pin, each access window being configured to accommodate axial adjustment of the punch assembly within the bushing or punch guide, while maintaining access to the first and second ends of the coupling pin for manipulation thereof.

12. The punch assembly of claim 5, further comprising an axial alignment pin disposed in one of the punch tip and the punch body, the axial alignment pin configured for angular orientation of the punch tip about the axis of the punch body by axial engagement with a complementary alignment slot disposed in another of the punch tip and punch body.

13. The punch assembly of claim 5, further comprising a radial alignment pin disposed in one of the punch tip and the punch body, the radial alignment pin configured for angular orientation of the punch tip about the axis of the punch body by radial engagement with a complementary alignment slot disposed in another of the punch tip and punch body.

14. The punch assembly of claim 5, wherein the coupling pin is configured for angular orientation of the punch tip with respect to the punch body by lateral engagement of the middle portion of the coupling pin within a precision receiving slot defined in the punch tip stem, absent other pin and slot alignment features configured for angular orientation of the punch tip with respect to the punch body.

15. The punch assembly of claim 5, further comprising a flange on the punch tip, the flange configured to transfer a compressive load from a bottom surface of the punch body to a working end of the punch tip during the punching operation in the punch press, wherein the coupling pin is substantially isolated from the compressive load.

16. The punch assembly of claim 5, further comprising an elastic member disposed in biasing relationship between the punch body and the punch tip when the punch tip stem is engaged in the axial cavity, the elastic member comprising one or more of an elastic bumper member, an O-ring, a spring and a ball plunger configured to reduce relative motion of the punch tip and punch body.

17. The punch assembly of claim 5, wherein a diameter of the punch tip stem is smaller than an outside diameter of the first end of the punch tip.

18. A punch system comprising:

a punch assembly comprising:

a punch body configured for a punching operation in a punch press, the punch body having an axis and an axial cavity defined along the axis;

a removable, unitary punch tip extending from a first end portion configured for the punching operation to a second end portion comprising a punch tip stem configured for selective engagement and disengagement within the axial cavity in the punch body, along the axis;

a coupling pin disposed transverse to the axis of the punch body, the coupling pin comprising a first end, a second end, and a middle portion between the first and second ends;

first and second openings in the punch body configured for selective engagement and disengagement with the first and second ends of the coupling pin; and a lateral cavity in the punch tip stem configured for selective engagement and disengagement with the middle portion of the coupling pin;

wherein the first end of the coupling pin is configured for manipulation of the coupling pin transverse to the axis of the punch body to selectively engage and disengage the punch tip stem, the first and second ends being configured for manipulation of the coupling pin transverse to the axis of the punch body to selectively engage and disengage the middle portion with the punch body and the punch tip; and wherein the coupling pin has a first position in which the punch tip and punch body are engaged with the first and second ends of the coupling pin disposed within an outer diameter thereof, and a second position in which the punch tip and punch body are disengaged with at least one of the first and second ends of the coupling pin disposed outside the outer diameter.

19. The punch system of claim 18, further comprising a bias member configured to selectively engage and disengage one or more grooves or detents in the coupling pin, in the first and second positions thereof.

20. The punch system of claim 19, wherein the one or more grooves or detents defines an asymmetric geometry at the first and second ends of the coupling pin, the asymmetric geometry adapted for increasing a force required to remove the coupling pin, as compared to manipulating the coupling pin between the first and second positions.

21. The punch system of claim 18, further comprising an alignment slot disposed in one of the punch body and the punch tip and a complementary alignment pin disposed in another of the punch body and the punch tip, the alignment slot and pin configured for axial or radial engagement to maintain precision orientation of the punch tip with respect to the punch body.

22. The punch system of claim 21, wherein the alignment pin comprises a through pin configured for radial engagement with a lateral alignment slot extending through the punch tip and the punch body.

23. The punch system of claim 18, further comprising an ejector configured to urge the punch tip from the punch body along the axis when the coupling pin is manipulated from the first position to the second position.

24. The punch system of claim 18, further comprising a pocket in the punch body or punch tip proximate the first end of the coupling pin, wherein the pocket defines a straight or curved recess adapted for manual access to push or pull the first end of the coupling pin transverse to the axis of the punch body.

25. The punch system of claim 18, further comprising straight or curved recesses defined in opposing positions on an outer diameter of the punch body or punch tip, the recesses adapted for manual access to push or pull each of the first and second ends of the coupling pin transverse to the axis of the punch body.

26. The punch system of claim 18, wherein a diameter of the punch tip stem is smaller than an outside diameter of the first end of the punch tip.

* * * * *